United States Patent [19]

Bland et al.

[11] Patent Number: 4,880,062

[45] Date of Patent: Nov. 14, 1989

[54] OIL WELL DOWNHOLE LIQUID INJECTION ASSEMBLY

[75] Inventors: Linden Bland, Calgary; Clifford J. Anderson, Sherwood Park, both of Canada

[73] Assignee: Murphy Oil Company Limited, Calgary, Canada

[21] Appl. No.: 75,566

[22] Filed: Jul. 20, 1987

[51] Int. Cl.[4] ..... E21B 43/00; E21B 34/12; F04B 21/00

[52] U.S. Cl. ..... 166/371; 166/373; 166/105; 137/625.5; 417/431; 417/554

[58] Field of Search ..... 166/372, 371, 373, 386, 166/105, 68, 68.5; 137/625.5, 469; 417/431, 432, 549, 552, 554

[56] References Cited

U.S. PATENT DOCUMENTS

| | | | |
|---|---|---|---|
| 1,337,593 | 4/1920 | Coulson | 417/431 |
| 1,338,907 | 5/1920 | Coulson | 417/432 |
| 1,338,943 | 5/1920 | MacKenzie | 417/432 |
| 2,639,674 | 5/1953 | Reese | 166/105 |
| 2,814,992 | 12/1957 | Humason | 166/68.5 |
| 4,089,626 | 5/1978 | Hill et al. | 417/431 |

*Primary Examiner*—Bruce M. Kisliuk
*Attorney, Agent, or Firm*—Ernest P. Johnson

[57] ABSTRACT

A downhole pump is actuated by a reciprocating unit comprising a tubular rod string, a valve assembly, and a tubular plunger rod. A flow passage extends through the reciprocating unit when the valve assembly is in an "open" position, whereby liquid may be injected into the pump barrel chamber to ensure the presence of incompressible fluid in the chamber from the beginning of the up stroke, to thereby reduce or eliminate gas locking of the pump. The valve assembly, which moves together with the reciprocating unit of which it is part, is adapted to interact with a stop member on the stationary pump barrel, to initiate opening of the valve as the rod string approaches the bottom of its stroke. The valve assembly is further adapted to automatically close when lifted away from the stop shortly after the beginning of the up stroke. The valve thus remains open only during the bottoming out phase of the stroke, when only limited travel of the reciprocating unit occurs. The valve assembly is adapted to accommodate this limited travel while remaining open.

6 Claims, 17 Drawing Sheets

9
4
1
9a
5
8
7
6
20
22
21
2
18
19
21
10
11
15
2
3
17
13
16
14
29
12
31
11
23
24
3

31
26
32
26a
30
27
13
25

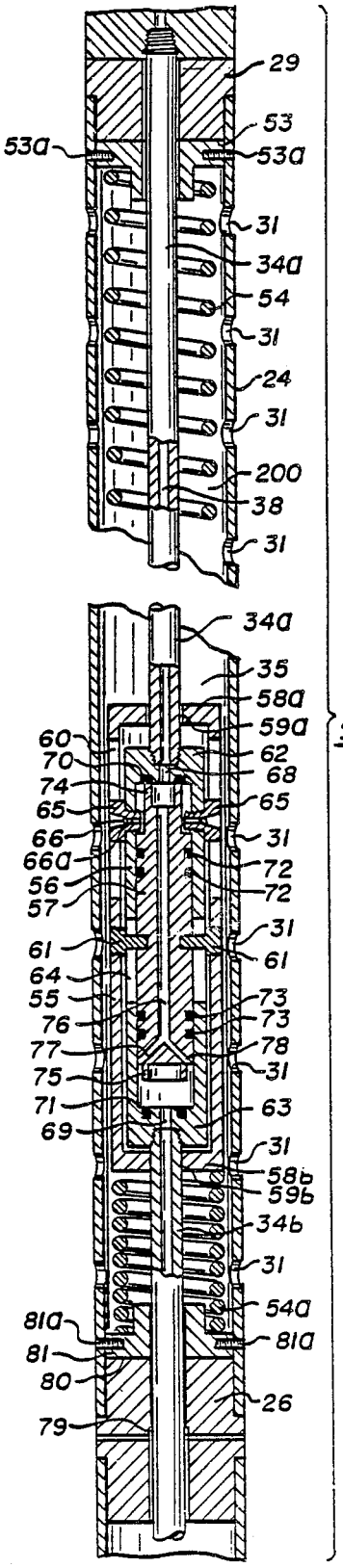
Fig. 5b.
Fig. 6b.
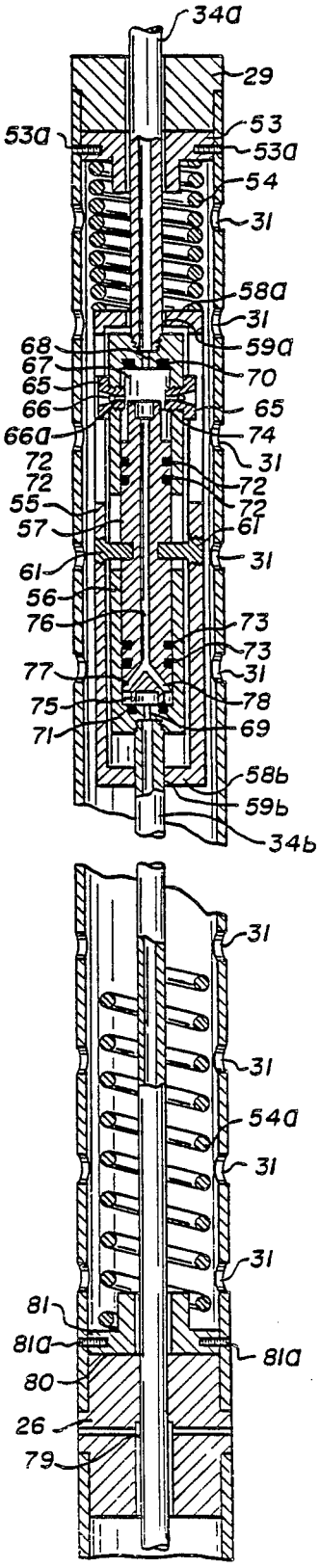

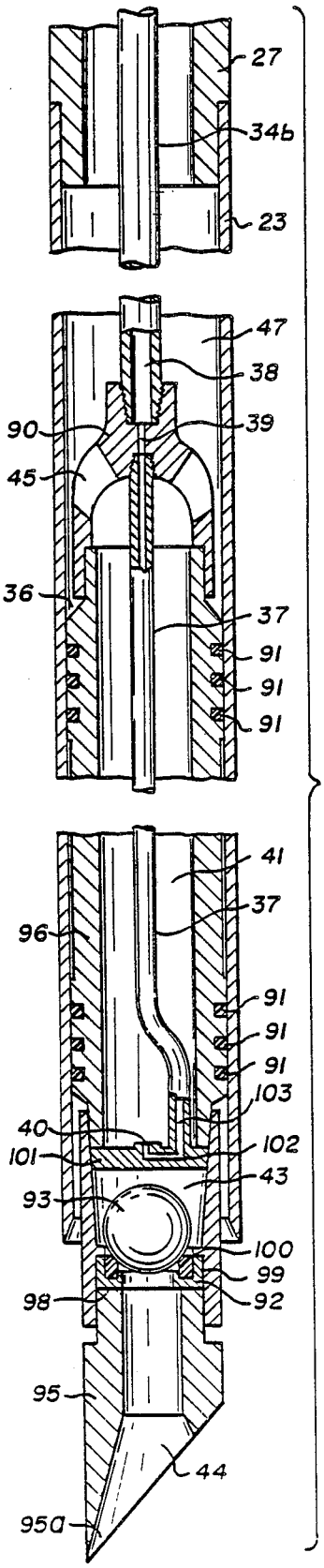
Fig. 5d.
Fig. 6d.
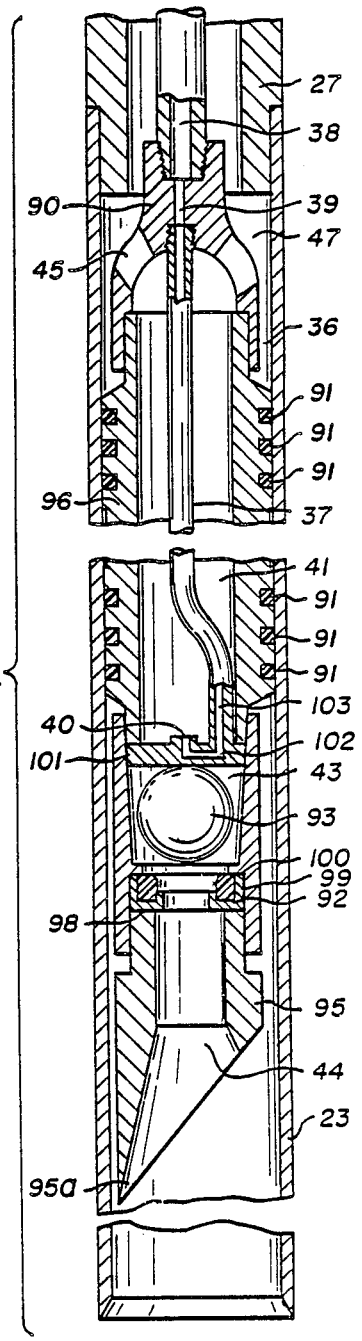

OIL WELL DOWNHOLE LIQUID INJECTION ASSEMBLY

FIELD OF THE INVENTION

This invention relates to apparatus and method for reducing gas locking of a reciprocating downhole pump in a producing well. In one aspect, it relates to a valve assembly for enabling the injection of liquid through a hollow rod string into the operating chamber of the pump for a finite period of time during part of the stroke, preferably during bottoming of the stroke, to thereby ensure that there is sufficient incompressible fluid in the chamber to reduce or eliminate gas locking. In another aspect, it relates to the method of so injecting the liquid into the chamber.

BACKGROUND OF THE INVENTION

There are production fluids, produced from oil reservoirs, which do not lend themselves to being efficiently pumped on a long term basis with commercial downhole pumps. One such fluid is the viscous, gassy, sand-laden fluid produced from a sand reservoir undergoing in situ combustion. When a conventional downhole pump is newly installed in this service, it often loses efficiency or becomes gas-locked due to the presence of gassy emulsions.

This problem can be better comprehended when discussed in the context of a prior art downhole pump illustrated in simplified form in FIGS. 1*a* and 1*b*. The known pump comprises a barrel a which seats in the seating nipple b of a tubing string c. A rod string d extends from surface into the barrel a. The rod string d carries a hollow cylindrical plunger f at its lower end. The plunger f has a small clearance fit (in the order of 1/1000 of an inch) with respect to the barrel a. This close fit is relied on to provide a liquid-tight seal between them. A ball valve member r and ring seat member s, forming the functioning parts of a travelling valve g, are positioned at the base of the plunger f; the travelling Valve g is operative to permit produced wellbore fluid to enter the plunger f on the down stroke of the rod string; on the up stroke, the valve g closes or seals the inlet x of the plunger f. Ports h connect the bore i, extending through the plunger f, with the barrel chamber j. Oil transfer ports k, extending through the barrel wall, connect the barrel chamber j with the tubing annulus 1 at a point above the seating nipple b. Flow through the oil transfer ports k is controlled by a standing valve m, comprising a ring valve member n and a stationary ring seat member o. The ring valve member n has a small clearance fit (in the order of 1/1000 of an inch) around the rod string d to effect a liquid-tight seal.

A comparatively high pressure, generated by the long column of fluid in the tubing annulus l, exists at the oil transfer ports k; a comparatively low pressure, generated by the short column of fluid in the casing annulus p, exists at the base of the plunger travelling valve g.

The operation of this prior art downhole pump is now described. When the plunger f and rod string d are on the down stroke (as shown in FIG. 1*b*), the standing valve ring valve member n is seated, thereby isolating the tubing annulus 1 from the barrel chamber j by closing the oil transfer ports k. The high pressure present in the tubing annulus l is therefore sealed off from the barrel chamber j. The downward movement of the plunger f creates a low pressure condition in the barrel chamber j. Under these conditions, the relatively higher pressure present in the casing annulus p is able to unseat the ball valve member r of the travelling valve g, and thus reservoir fluid is able to enter the plunger f and fill the barrel chamber j. Upon completion of the downstroke, the pressure in the barrel chamber j equalizes with the casing annulus p pressure and the travelling valve g closes. As the plunger f moves upward, it compresses the fluid in the barrel chamber j until this pressure exceeds that of the tubing annulus 1 and the standing valve ring valve member n is unseated, as shown in FIG. 1*a*. The plunger f now acts as a swab and pushes the fluid within the barrel chamber j through the oil transfer port k into the tubing annulus 1. When the upstroke is completed and the fluid has been so displaced, the rod string d begins to move downwardly, thereby seating the ring valve member n, and the cycle is repeated.

These prior art downhole pumps are affected by a problem, referred to as "gas-locking". As previously mentioned, the fluid, produced by a reservoir undergoing in situ combustion, contains considerable quantities of combustion gases. Gas-locking occurs when there is so much gas in the fluid in the plunger bore and barrel chamber, that the plunger simply compresses this gas on the upstroke, rather than displacing fluid (that is, liquid and gas) into the tubing annulus. The result of gas-locking is that little, if any fluid is removed by the pump, since the gas compresses on the upstroke, so that the pressure in the barrel chamber does not become high enough to open the standing valve, and the gas expands on the downstroke, so that the pressure does not become low enough for the travelling valve to open.

There is thus a need for an improved system which counteracts gas-locking of the pump.

SUMMARY OF THE INVENTION

In accordance with one aspect of the present invention, there is provided a novel valve assembly which is an integral part of a reciprocating unit which includes a tubular rod string and a tubular pump plunger rod. The bore of the plunger rod is arranged to communicate with the pump barrel chamber. The valve assembly is usually positioned to interconnect the rod string and the plunger rod. When open, the valve assembly provides a bore which connects the rod string and plunger rod bores, thereby creating a through passage and making it possible for liquid injected into the rod string bore to enter the pump barrel chamber. When closed, the valve assembly interrupts the through passage and isolates the barrel chamber from communication with the rod string bore.

The valve assembly is operative to open for part of the stroke, preferably when the reciprocating unit is approaching the bottom of said stroke. The valve assembly remains open for a finite period of time while the unit is near or at the bottom of the stroke and then automatically closes during the upstroke of the unit.

By opening in this intermittent fashion, the valve assembly enables a slug of liquid, such as water, to be injected once each stroke through the reciprocating unit into the pump barrel chamber. The presence of this slug of substantially incompressible liquid in the chamber during the upstroke ensures that sufficient pressure can be generated in the chamber on the upstroke to unseat the standing valve. As a result, gas locking of the pump is eliminated or reduced.

The valve assembly preferably comprises a vertically movable slider member, which forms the longitudinally extending bore for connecting the rod string bore with the pump plunger rod bore. The slider member is positioned in a tubular housing member joining the rod string and pump plunger rod. Said slider member can shift between a lowermost closed position, in which it interrupts communication between the rod string bore and the plunger rod bore, and an upwardly displaced open position, in which it permits such communication.

The shifting of the slider member between closed and open positions is preferably implemented by a movable first member. This first member may take the form of a sleeve, circumscribing the housing member and having means, such as pins, joining it with the slider member so that they move together as a unit in a vertical direction. The pins extend outwardly through longitudinally extending slots formed in the housing member wall. The sleeve is adapted to contact an appropriately positioned stationary stop member, forming part of the pump barrel or tubing string, preferably when the reciprocating unit is approaching the bottom of its stroke. When the sleeve contacts the stop member, its downward travel is terminated, thereby inducing a shift of the slider member relative to the still-travelling housing member, whereby the slider member is unseated and assumes the open position. The slots permit the housing member to continue moving with the rod string and plunger rod a short distance, to complete the bottoming of the stroke, while the slider member and attached sleeve remain stationary and unseated. When the reciprocating unit starts on the upstroke, the housing member is drawn upwardly through the sleeve until the pins reach the lower ends of the slots, at which point the sleeve is lifted away from the stop member Pressure differential acting on the slider member and/or a spring causes it to move downwardly relative to the housing member and assume the seated or closed position, thereby terminating liquid injection into the barrel chamber. The valve assembly thereafter remains closed until the sleeve again comes in contact with the stop member as the stroke is again bottoming out.

There is thus provided a mechanically simple and self-actuating shift valve which is designed to take advantage of the reciprocating nature of the rod string and the stationary nature of the pump barrel or tubing, to induce opening and closing of the valve assembly during a stroke cycle, preferably across the short period of the "bottoming" or "tapping down" of the stroke.

Broadly stated, in one aspect, the invention is a method for reducing gas locking of an oil well downhole reciprocating pump seated in a well, said well being equipped with a tubing string and a tubular rod string for reciprocating the pump, said pump having a tubular barrel, forming an internal chamber, a plunger assembly comprising a hollow plunger and a tubular plunger rod, said plunger assembly communicating with the barrel chamber and being connected with the rod string, to form a reciprocating unit, said rod string being connected at surface with means for injecting liquid thereinto, and a valve assembly connected into the reciprocating unit and adapted to control liquid flow through the unit into the barrel chamber, said method comprising: injecting liquid into the rod string; opening the valve assembly, when the rod string is at about the bottom of its down stroke, by bringing said valve assembly, as a result of its movement with the rod string, into contact with a stationary stop member carried by the tubing string or the pump barrel, to thereby initiate liquid flow into the barrel chamber from the rod string; and closing the valve assembly, as the rod string rises on the up stroke, in response to removing said valve assembly out of contact with the stop member, to thereby terminate liquid flow into the barrel chamber from the rod string; whereby some substantially incompressible liquid is introduced into the barrel chamber so as to be present there during the up stroke, to thereby reduce gas locking of the pump.

Broadly stated, in another aspect, the invention is an assembly for pumping an oil-producing well comprising: a tubing string installed in the well; a downhole pump seated in the tubing string; a reciprocable tubular rod string, positioned in the tubing string, for actuating the pump, said rod and tubing strings forming a tubing annulus between them; means, connected with the rod string at ground surface, for reciprocating said rod string; means, connected with the rod string at ground surface, for injecting liquid into the bore of the rod string; said pump comprising a tubular barrel forming an internal chamber, a standing valve assembly associated with the barrel, a hollow plunger positioned in the barrel chamber in slidable sealing engagement with said barrel's inner surface, said plunger closing off the lower end of the chamber, a travelling valve assembly, associated with the plunger, for controlling and enabling fluid to flow from the well bore through the plunger into the barrel chamber on the down stroke of the rod string, said travelling valve assembly being adapted to close at the start of the up stroke and to open again at the start of the down stroke, and a tubular plunger rod connected with the plunger to form a plunger assembly, said plunger assembly communicating with the barrel chamber and being connected with the rod string to form a reciprocating unit, a valve assembly, being interconnected with and forming part of the reciprocating unit, said valve assembly being convertible between an open position, in which liquid injected into the rod string bore may pass through the valve assembly into the plunger rod bore and the barrel chamber, and a closed position, in which liquid in the rod string bore is blocked from moving into the barrel chamber; a stationary stop member associated with one of the barrel or the tubing string; said valve assembly including a movable first member arranged to contact the stop member, when the rod string is approaching the bottom of its down stroke, to open the valve assembly in reaction to said contact and the concomitant stopping of the first member's movement, said valve assembly being operative to automatically close when the first member is removed from contact with the stationary stop member by the upward movement of the reciprocating unit on the up stroke; whereby some liquid may be introduced, through the rod string, valve assembly and plunger rod, into the barrel chamber in conjunction with the bottoming of the stroke, to reduce gas locking of the pump.

Broadly stated, in still another aspect, the invention is a valve assembly, for connection in a reciprocating unit comprising a tubular rod string and the tubular plunger rod of a downhole pump, for controlling the injection of water through the rod string and plunger rod, comprising: a tubular housing member having an internal bore and at least one vertical slot formed through its wall and extending part way along its length; a first member associated with the housing member at its lower end, said first member forming a substantially vertical first bore, said first member being connectable at its bottom end with the lower end portion of the reciprocating unit so that the first bore will communicate with the bore of the plunger rod, said first member forming a first annular seal surface at the upper end of the first bore; a second member associated with the housing member at its upper end, said second member forming a substantially vertical second bore, said second member being connectable at its upper end with the upper end portion of the reciprocating unit so that the second bore will communicate with the bore of the rod string; a cylindrical slider member disposed in the housing member bore, said slider member having a longitudinal bore extending therethrough which terminates at its lower end outside the first annular seal surface, said slider member carrying a second annular seal surface adapted to seal against the first annular seal surface when the slider member abuts the first member; a third member extending vertically along the outside surface of the housing member; means, extending through the slot, for interconnecting the slider member and the third member, whereby the slider member and third member are adapted to move vertically as a unit a short distance along the extent of the slot; means, positioned between the housing member and the slider member above and below the slot, for sealing to prevent liquid movement between said members; and means for normally urging the slider member downwardly to abut the first member whereby the slider member seal surface will contact the first annular seal surface and interrupt communication between the slider member bore and the first bore.

DESCRIPTION OF THE PREFERRED EMBODIMENT

Figures 3, 4:
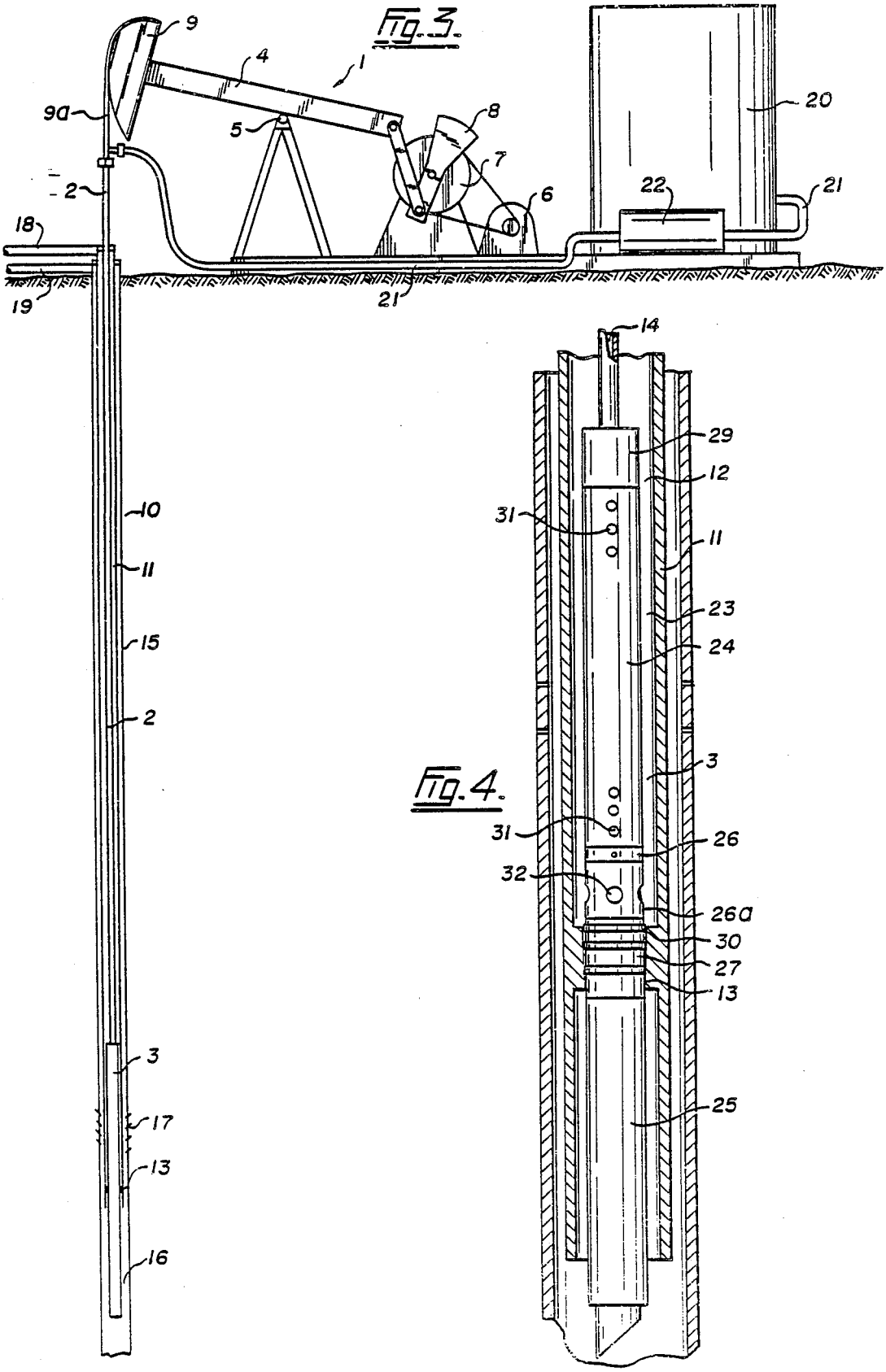
FIG. 3 is a schematic side view showing a typical oil well arrangement with the downhole pump in place.
FIG. 4 is a partly cross-sectional view showing the casing, tubing, seating nipple and preferred pump, at the bottom of a stroke.

With reference to FIGS. 3 and 4, a typical well system is shown. The system comprises a pump jack 1 adapted to reciprocate a rod string 2 to actuate a downhole pump 3. More particularly, the pump jack 1 comprises a walking beam 4 adapted to move in see-saw fashion about a pivot 5. A motor 6 acts through gear reducer 7 and linkage 8 to actuate the walking beam 4. The walking beam 4 carries a horse head 9 at its forward end, which is attached to the rod string 2 by a bridle 9*a*. The rod string 2 extends down a well bore 10 and is positioned concentrically within a similarly disposed tubing string 11. A tubing annulus 12 is formed between the rod string 2 and the tubing string 11. The tubing string 11 includes a seating nipple 13 at its lower end. The downhole pump 3, carried by the rod string 2 at the latter's lower end, is seated in the seating nipple 13. The rod string 2 is tubular or hollow and defines a central bore 14. The tubing string 11 is disposed within a casing string 15 and a casing annulus 16 is defined between them. The casing string 15 is shown to be perforated at 17 so that fluid produced by the surrounding reservoir may enter the casing annulus 16. The tubing string 11 and casing string 15 are respectively connected to surface lines 18 and 19 for the removal of produced fluids from the well. A water tank 20 at surface is connected through line 21 and pump 22 to the rod string 2 for the supply of water to the central bore 14 thereof.

FIRST EMBODIMENT

Figure 1A:
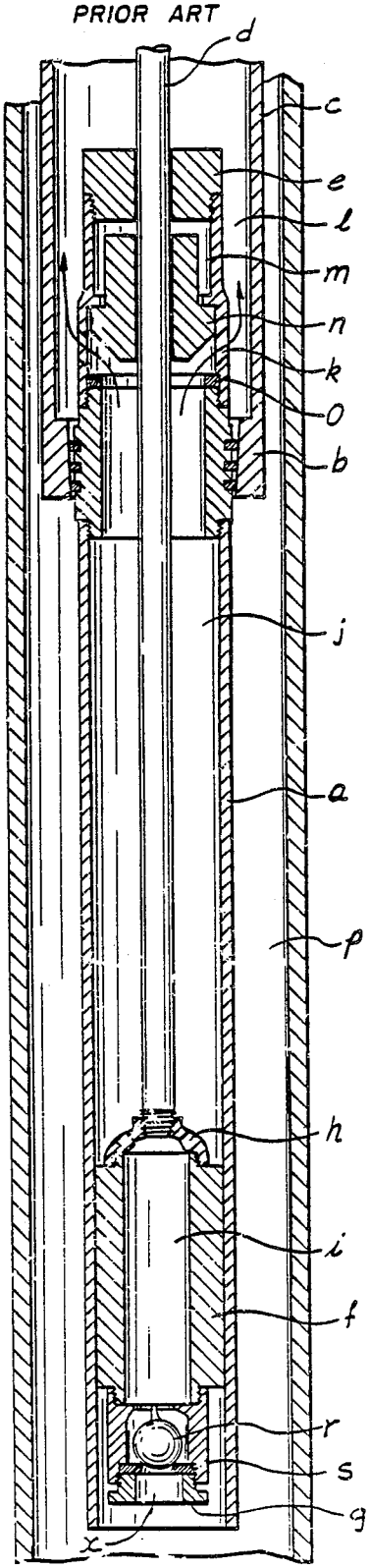
Fig. 1a. PRIOR ART
FIGS. 1(*a*) and 1(*b*) are schematic sectional views of a prior art downhole pump in simplified form showing the movement of fluids and the parts on the up and down strokes.
Figure 1B:
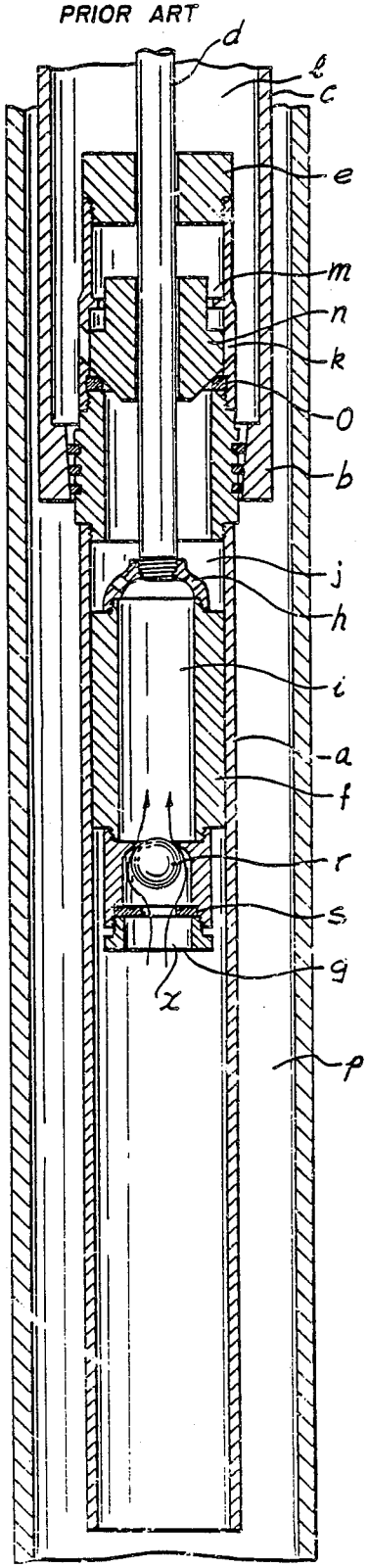
Fig. 1b. PRIOR ART
Figure 2A:
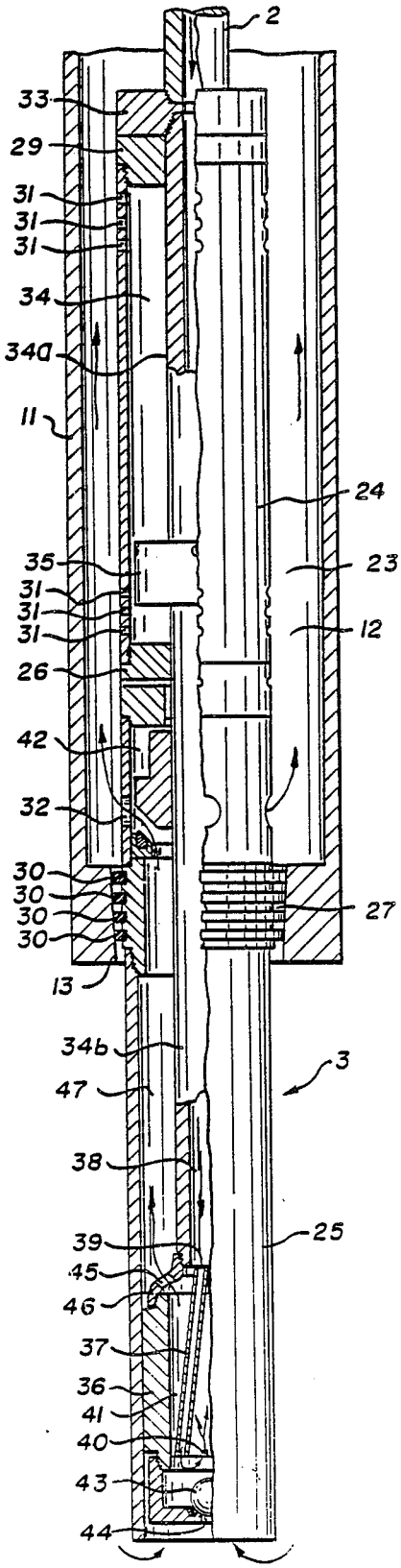
FIGS. 2(*a* )and 2(*b*) are schematic, partly sectional views of a preferred embodiment of the present pump in simplified form showing the movement of fluids and the parts on the up and down stroke.
Figure 2B:
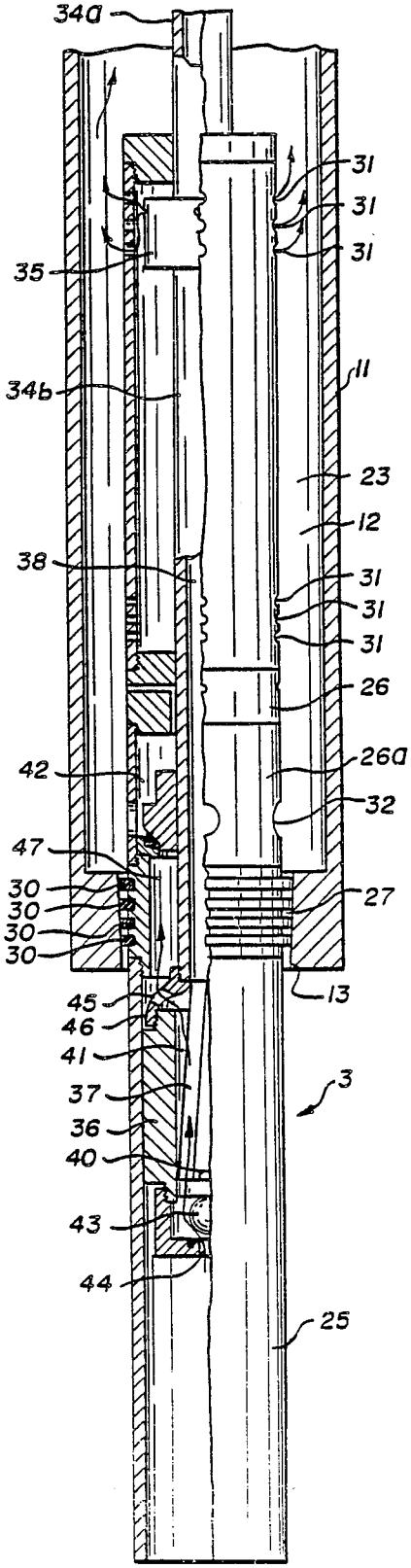

With reference to FIGS. 2(*a*) and 2(*b*), the pump 3 comprises a tubular barrel 23 consisting of five sections threaded end to end. More particularly, the barrel 23 comprises first and second sections 24 and 25, connected by a tubular coupling or bored transverse member 26, a standing valve section 26*a*, and a hold-down section 27. A bushing 29 provides closure at the upper end of the first section 24. The second section 25 is open ended at its base.

The barrel 23 provides upper and lower segments within which different operations occur as is explained below. The upper segment consists of that portion of the barrel 23 down to the coupling 26. The second segment consists of that portion of the barrel 23 below the coupling 26. Said coupling 26 functions to separate the two segments.

The hold-down section 27 carries conventional, externally mounted seating cups 30. These cups 30 function to adapt the hold-down section to seat in the tapered seating nipple 13 of the tubing string 11. They provide a liquid-tight seal at the base of the tubing annulus 12 and suspend the barrel 23 in fixed fashion from the tubing string 11.

The barrel's upper or first section 24 is perforated by water transfer ports 31, whose purpose will be explained below. The standing valve section **26*a* is also perforated by oil transfer ports 32**

Let us turn now to the inner parts of the device.

The tubular rod string 2 is connected at its lower end by a threaded coupling 33 to a tubular plunger rod 34. The plunger rod 34 comprises upper and lower sections **34*a* and 34*b*, which are interconnected by a valve assembly 35. This valve assembly 35 is located in the barrel's first section 24. The function of the valve assembly 35 is explained below. The plunger rod 34 extends down through the coupling 26, standing valve section 26*a*, hold-down section 27 and into the lower section 25 where, at its lower end, said plunger rod 34 is screwed into a plunger 36. The plunger 36 is hollow and defines a chamber 41. At its lower end, the plunger 36 is open-ended to provide an inlet 44. A water tube 37 is positioned within the plunger chamber 41. This water tube 37 communicates with the bore 38 of the plunger rod 34 through a bore 39, and terminates in an orifice outlet 40. This orifice outlet 40 communicates with the plunger chamber 41. The water tube 37 thus is an extension of the plunger rod 34 and can be considered part thereof. The plunger rod 34 therefore communicates with the plunger chamber 41**.

Thus it will be noted that water may be pumped from the surface through the reciprocating unit comprising the rod string 2 and plunger rod 34 into the plunger chamber 41, subject to the control of the valve assembly 35 whose workings are described below.

A standing valve 42 is associated with the plunger rod 34 at the oil transfer ports 32 and controls flow through said ports.

A travelling valve 43 is associated with the plunger 36 at its lower opening 44 and controls flow into the plunger chamber 41.

Plunger ports 45 extend through the upper end of the plunger wall 46 and provide communication between the plunger chamber 41 and the barrel chamber 47. Said barrel chamber 47 is formed between the plunger rod 34 and the barrel's lowermost section 25 and extends between the plunger 36 and the oil transfer ports 32.

Figure 5A:
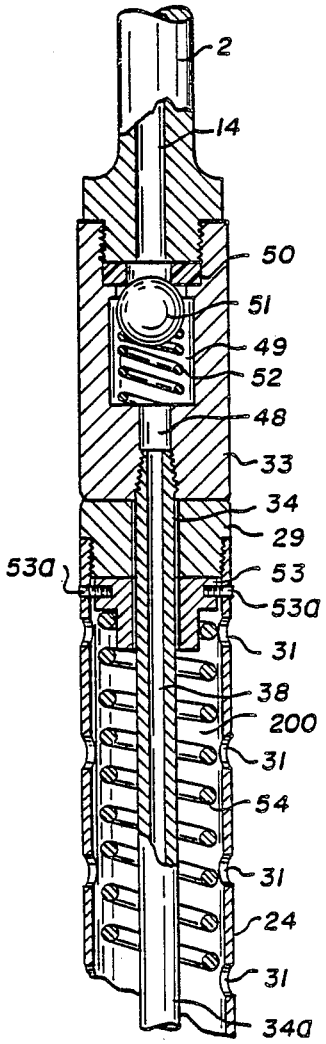
FIGS. 5(*a*), 5(*b*), 5(*c*), 5(*d*) show a preferred embodiment of the pump in detail at the bottom of the stroke—each figure shows a portion of the pump so that, when assembled in line, the four figures show the pump as a whole.
Figure 5C:
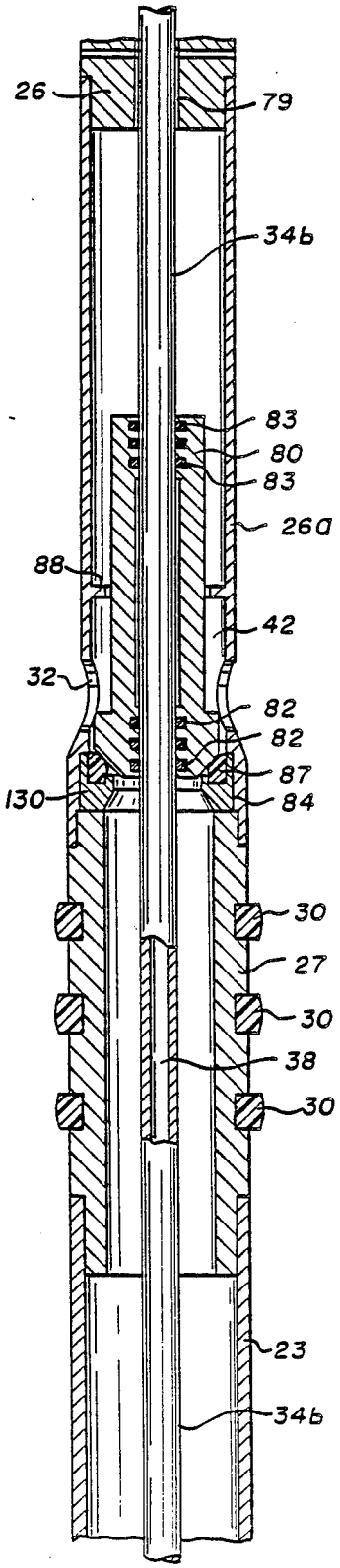

Referring now to FIGS. 5(*a*) to 5(*d*) and 6(*a*) to 6(*d*), the internals of the pump 3 will now be described in greater detail.

The bottom of the tubular rod string 2 is threaded into a coupling 33 which in turn has the upper end of the plunger rod 34 threaded into its lower end. A bore 48 extends through the coupling 33 to provide communication between the rod string bore 14 and the plunger rod bore 38.

The coupling 33 incorporates a check valve 49 to prevent upward flow through the bore 48. The check valve 49 comprises a downwardly directed ring seat 50, a valve ball 51, and a coil spring 52 which normally acts to urge the ball 51 upwardly to a closed position against the seat 50. As stated., the valve 49 acts to prevent upward flow of produced fluid into the rod string bore 14. However, the valve ball 51 may be unseated by pressure within the rod string bore 14 to permit downward movement of fluid into the plunger rod bore 38.

The plunger rod upper section **34*a* extends downwardly from the coupling 33 into the barrel 24 through the bored bushing 29. This bushing 29 provides closure at the top end of the barrel 24 and stabilizes rod 34*a*, although not providing a seal. A second bored bushing 53 is connected by means of set screws 53*a* to the undersurface of the bushing 29. The plunger rod section 34*a* extends through this bushing 53 as well. A coil spring 54 is brazed to the underside of the bushing 53 and extends concentrically and downwardly along the plunger rod section 34*a* a short distance, for a purpose to be explained The valve assembly 35 is attached to the plunger rod upper section 34*a* at the latter's lower end. This valve assembly 35 provides means for controlling liquid flow from the rod string 2**:

(1) to enable it to enter the water annulus 200 (formed between the barrel's first section 24 and the plunger rod 34 and valve assembly 35 and extending from the coupling 29 down to the coupling 26) on the downstroke only; and (2) to enable it to continue down through the plunger rod bore 38 on the upstroke only.

Figure 7A:
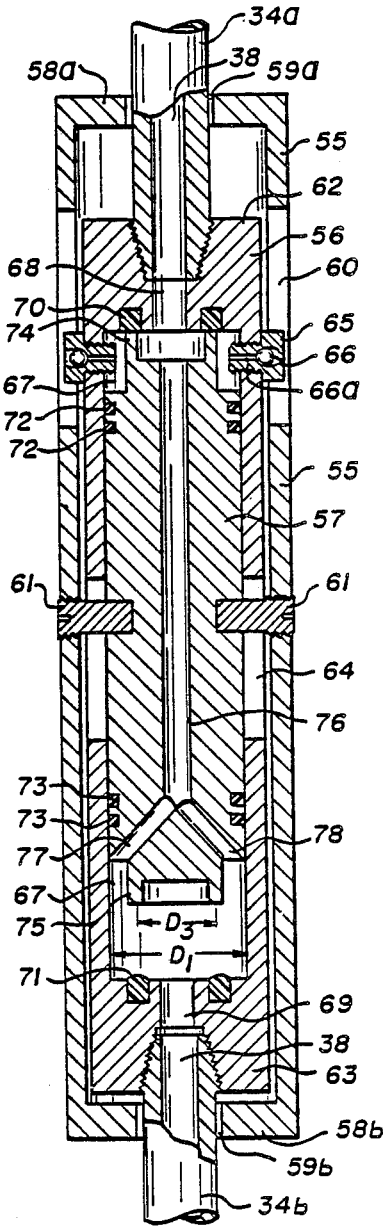
FIGS. 7(*a*) and 7(*b*) are enlarged sectional views of one embodiment of the shift valve in its two operating positions.
Figure 7B:
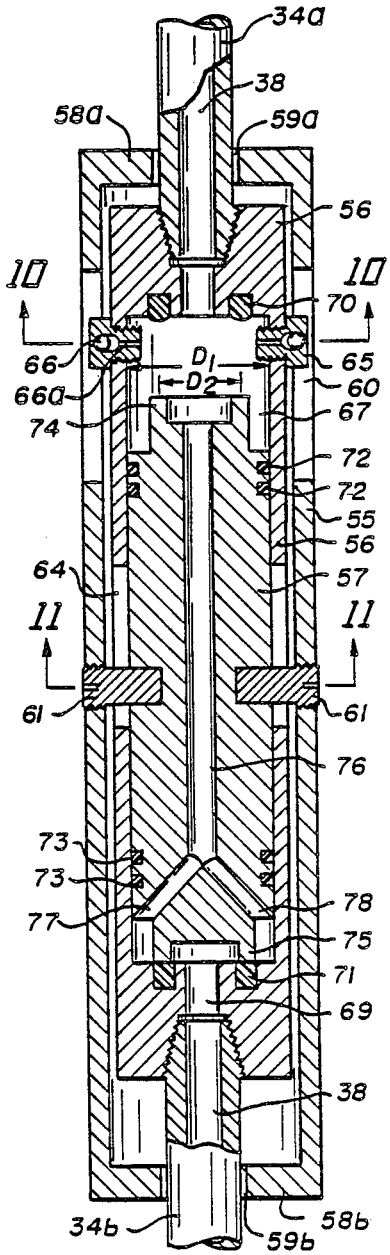
Figure 10:
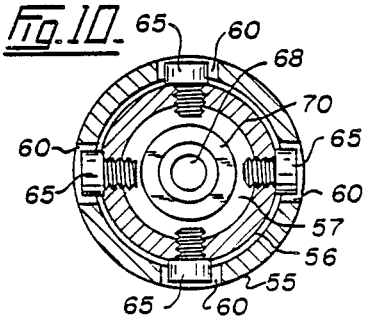
FIG. 10 is a transverse sectional view at 10—10 of FIG. 7(*b*)
Figure 11:
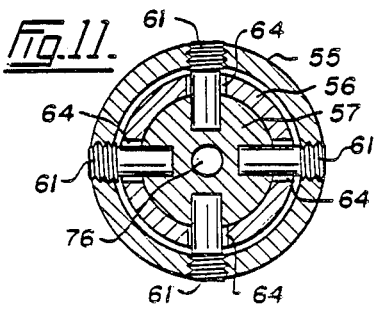
FIG. 11 is a transverse sectional view at 11—11 of FIG. 7(*b*)

It will be noted that the valve assembly 35 thus functions to permit fluid flow into the tubing annulus 12 (through the water annulus 200 and water ports 31) on the downstroke and into the plunger chamber 41 (through the plunger rod 34 and water tube 37) on the up Referring now to FIGS. 7(*a*) and 7(*b*), the valve assembly is shown in detail. It involves a three part assembly comprising an outer sleeve 55, a tubular housing member 56 disposed within the sleeve 55, and a slider member 57 positioned within the housing The outer sleeve 55 is hollow and cylindrical and has inwardly projecting shoulders **58*a* and 58*b* at its upper and lower ends. The shoulders 58*a* and 58*b* form openings 59*a* and 59*b* through which the plunger rod 34 extends. The sleeve 55 further defines a plurality of elongate slots 60 in its side wall. Pins 61 interconnect the sleeve with the slider member 57**, so that they move together as a unit.

The housing member 56 is also hollow and cylindrical and has upper and lower transverse end walls 62 and 63. Said housing member 56 has slots 64 formed in its side wall through which project the pins 61 which connect the sleeve 55 and slider member 57. The housing member 56 also has a plurality of ports 65 extending through its side wall at its upper end. These ports 65 are controlled by check valves 66 and orifices **66*a* so that flow may only pass at a predetermined rate outwardly from the inner chamber 67, defined by the housing member 56. Said housing member 56 is threadably connected at its upper end with the upper section 34*a* of the plunger rod 34 and at its lower end with the lower section 34*b* of said plunger rod. A first bore 68 connects the bore of the plunger rod section 34*a* with the upper end of the chamber 67. A second bore 69 connects the bore of the plunger rod section 34***b* with the lower end of the chamber 67. A ring seal 70 is mounted in the upper end wall 62 of the housing member 56. This seal 70 circumscribes the first bore 68. Similarly, a ring seal 71 is mounted in the lower end wall 63 about the second bore 69.

The slider member 57 is a cylindrical solid member having external upper and lower ring seals 72 and 73 which seal against the inside surface of the housing member 56. At each of its upper and lower ends, the slider member 57 carries rings 74 and 75 which are adapted to seal against one of the ring seals 70 and 71 carried by the housing member 56. A bore 76 extends centrally downwardly through the slider member 57 from the area within the ring 74. This bore divides into a plurality of bores 77 and 78 which terminate at the bottom end of the slider member 57 in the area external of the ring 75.

It will be seen that, in the position shown in FIGS. 5(*b*) and 7(*a*), water pumped down the rod string 2 will pass through the bores 68, 76, 77, and 78 into the lower end of the chamber 67 and on through the bore 69 into the plunger rod lower section 34*b*. In the position shown in FIGS. 6(*b*) and 7(*b*), the water pumped down the rod string 2 enters the upper end of the chamber 67 because the ring 74 is not seated and may pass through the ports 65 and water ports 31 into the tubing annulus 12. The seals 72 and 73 on the slider member 57 and its ring 75 sealing on seal 71 function to prevent water from entering the bore 38 of the plunger rod lower section 34*b*.

The means for actuating the slider member 57 will now be described. As previously mentioned, the upper barrel section 24 (in which the valve assembly is located) is connected to the lower barrel section 25 by a coupling 26. This coupling 26 defines a central bore 79 through which the plunger rod 34 extends. The coupling 26 also provides a transverse shoulder 80 on which is mounted a bored bushing 81 by means of set screws 81*a*. The bushing 81 supports an upwardly extending spring 54*a* (preferably brazed to bushing 81) which circumscribes the plunger rod 34. When the rod string 2 reciprocates, it lifts and lowers the plunger rod 34 on which the valve assembly 35 is positioned. As the rod string 2 approaches the bottom of the downstroke, the outer sleeve 55 and attached slider member 57 contact the spring 54*a* and are shifted upwardly when the spring force overcomes the seating force with the result that the slider ring 74 seats against the ring seal 70 (as shown in FIG. 5(*b*) ). Thus, water may pass through the rod string 2 and slider bores 76, 77, and 78 into the lower plunger rod section bore 38 and on into the plunger chamber 41 and barrel chamber 47 during the subsequent upstroke.

Referring to FIG. 7(*a*), once the slider member 57 seats with ring seal 74 against ring seat 70, the fluid pressure maintained in the rod bore 38 by means of the surface pump 22 acts on the cross-sectional area associated with diameter $D_1$ and the cross-sectional area associated with the diameter $D_2$. This pressure is higher than the pressure in the tubing annulus 12 by a value $\Delta P_1$. The force $F_1$ seating the slider member 57 against seat 70 is $$F_1=\Delta P_1(D_1^2-D_2^2)\pi/4$$

The values $\Delta P_1$, $D_1$ and $D_2$ are generally chosen to maintain the seating force at about 50 pounds to 100 pounds. Near the end of the upstroke, the outer sleeve 55 contacts the spring 54 and is shifted downwardly together with its attached slider member 57 when the spring force overcomes the seating force. As a result, water may move downwardly out of the upper plunger rod section 34*a* into the housing member chamber 67 and pass outwardly through the ports 65 and 31 into the tubing annulus 12.

Referring to FIG. 7(*b*), once the slider member 57 seats with ring seat 75 against ring seal 71, the fluid pressure maintained in chamber 67 by means of the surface pump 22 acting against the restricted orifices 66*a* acts on the cross-sectional area associated with diameter $D_1$. The pressure in chamber 67 is higher than the pressure in bore 69 and lower rod bore 38 by $\Delta P_2$. The force $F_2$ seating the slider member 57 against seat 71 is:

$$F_2=\Delta P_2\pi(D_3^2/4)$$

The values $P_2$ and $D_3$ are generally chosen to maintain the seating force at about 50 pounds to 100 pounds.

Referring now to FIGS. 5(*c*), 5(*d*), 6(*c*) and 6(*d*) and progressing on down the plunger rod 34, we note it extends through an elongate, generally tubular standing valve ring valve member 80. Valve member 80 has a bevelled seal face 81 at its lower end. On its inner surface, the valve member 80 carries lower and upper ring seals 82 and 83, which seal against the outer surface of the plunger rod 34.

Figure 13:
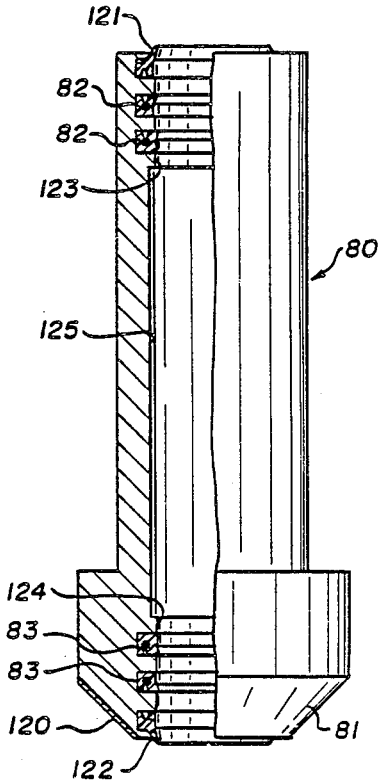
FIG. 13 is a partial sectional view of the ring valve member showing details of construction.

Referring to FIG. 13, a preferred ring valve member 80 is shown in detail. The valve member 80 is provided with face 81 which has hardened surface 120 applied. The surface 120 may be of any one of the fused surfaces in the range of RC 60 hardness. Internal of ring 80 is relieved bore 125 which is nominally 0.025 to 0.050 inches diameter larger than rod 34*b* and bores 123 and 124 which are finished to 0.002 to 0.004 inches larger than rod 34*b*. At either end of the ring valve member 80 are mounted wiper rings 121 and 122, which serve to minimize particulate matter reaching seals 82 and 83. These seals 82 and 83, of which two of each are provided, are of the TM Parker polypak O-spring energized abrasion-resistant lip seal type of seal ring. The seal rings protrude outwardly from their groove seats and are deformable and resilient. Urethane seal rings suitable for use have a moderate hardness, typically within the range Shore D-45 to 65.

A standing valve seat member 84 is positioned on a shoulder 85 at the top of the barrel hold-down section 27. This seat member 84 is locked in place by a shoulder 86 at the base of the barrel's standing valve section 26*a*.

Figure 8A:
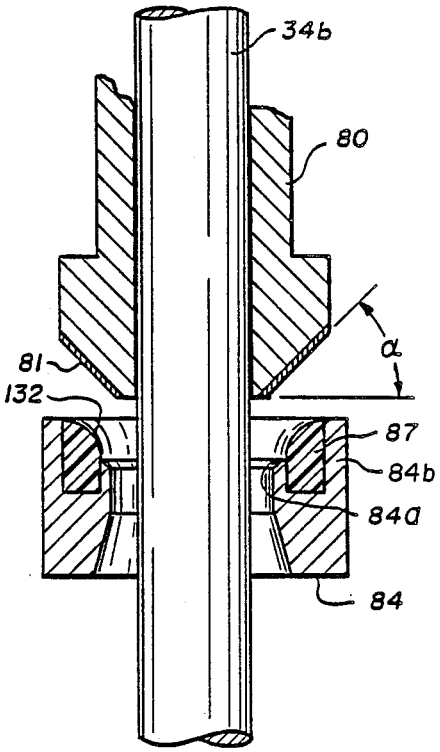
FIGS. 8(*a*) and 8(*b*) are enlarged sectional views of the standing valve seat and the standing valve face in the unseated and seated positions.
Figure 8B:
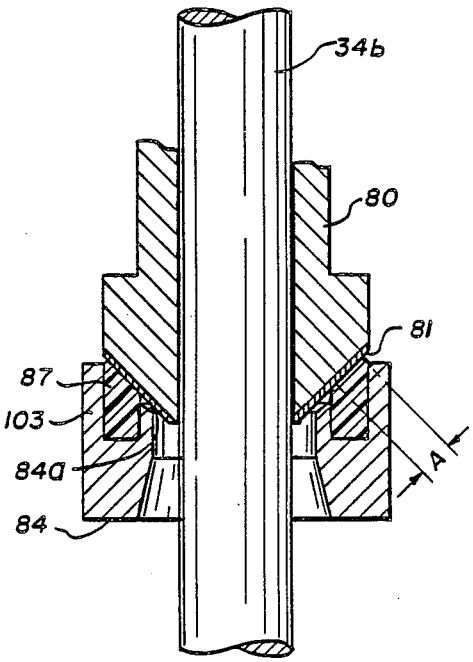

Referring to FIGS. 8(*a*) and 8(*b*), the standing valve seat member 84 comprises a rigid annular member 84*b* which forms an annular groove 84*a* in its upper surface. A ring 87 of deformable, resilient elastomeric material is retained in the groove 84*a* and is supported on three sides by the rigid member 84*b*.

The urethane elastomer ring 87 is contoured to provide a curved, upwardly protruding surface 132, so that the contact area "A" between the urethane surface 132 and the face 81 of the ring valve member 80 increases as the seating load increases. The seating angle $\alpha$, which is normally chosen to be 45 degrees, aids in the sealing of seating surface 81 with surface 132, due to the wedging action which is created.

The urethane chosen for the ring 87 preferably has a hardness in the range Shore D-45 to 65.

It will be noted that the oil transfer ports 32 are positioned directly above the standing valve seat member 84.

The barrel's standing valve section 26*a* has an inwardly projecting shoulder 88 spaced a short distance above the oil transfer ports 32. This shoulder 88 functions to limit the upward travel of the standing valve ring member 80.

Moving on down the plunger rod 34, we note that it is threaded into the upper end of the plunger 36. The plunger 36 is generally tubular, having a closure cap 90, at its upper end, and an open lower end. As previously stated, ports 45 extend through the wall of the cap 90 and connect the chamber 41, internal of the plunger 36, with the barrel chamber 47. On its outer surface, the plunger 36 carries upper and lower ring seals 91. These seals 91 provide a seal between the barrel 23 and plunger 36.

Figure 12:
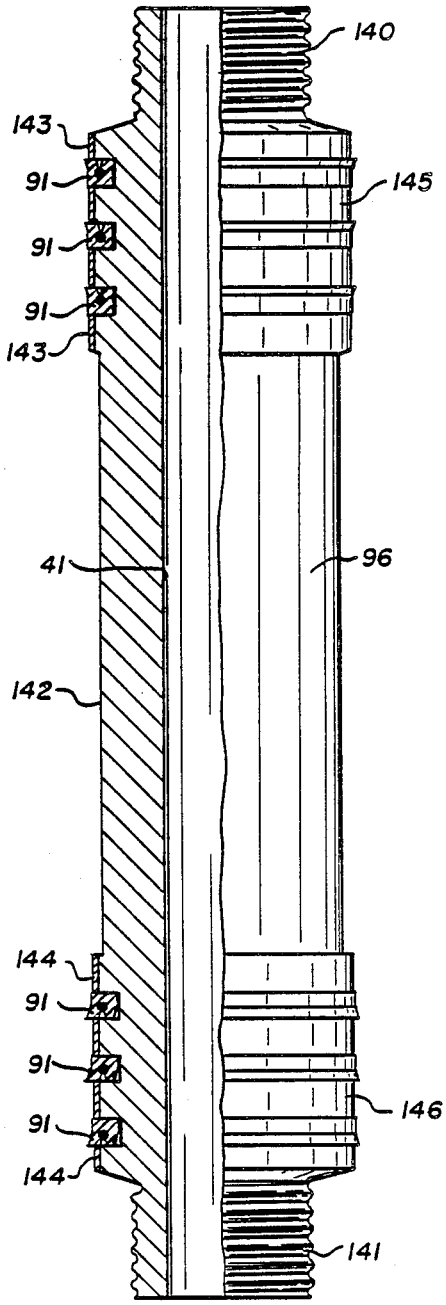
FIG. 12 is a partial sectional view of the pump plunger showing details of construction.

Referring to FIG. 12, the plunger main body 96 carries three seals 91 at the top, sealing upwards, and three seals 91 at the bottom, sealing downwards. The seals 91 are of the resilient liquid-tight TM Parker polypak O-ring energized abrasion-resistant type previously described. They protrude outwardly from the surface of the body 96. By providing upwardly and downwardly directed groups of seals at the extremities of the plunger body, the accumulation of abrasive debris between the plunger and barrel is minimized. The plunger main body 96 is provided with threaded ends 140 and 141 and forms an internal bore 41. The ends 145 and 146 of the plunger main body 96, which receive seals 91, are hard-faced at 143 and 144, with material such as a fused coating of about RC 60 hardness, and finished to 0.001 to 0.002 inches under the barrel 23 inside diameter. The central portion of the exterior surface 142 of body 96 is relieved to about 0.050 inches under the barrel 23 inside diameter.

Figure 9A:
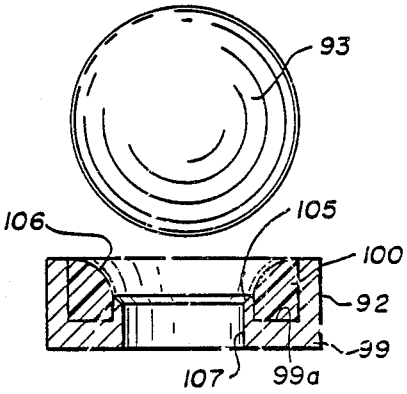
FIGS. 9(*a*) and 9(*b*) are enlarged sectional views of the travelling valve seat and the travelling valve ball in the unseated and seated positions.
Figure 9B:
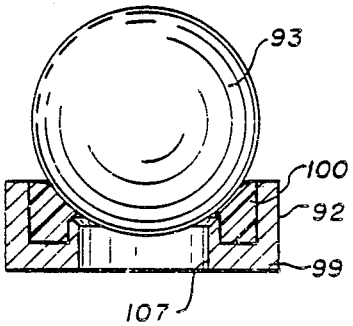

A travelling valve 43 is carried by the plunger 36 at the latter's lower end. As shown in FIGS. 9*a*, 9*b*, the valve 43 comprises a ring seat member 92 and a valve member or ball 93. As shown in FIG. 14*c* , the lower end of the plunger 36 is formed of two tubular members 94 and 95 screwed together end to end. The upper member 94 is attached to the lower end of the main body 96 of the plunger 36. The upper member 94 has an inwardly projecting shoulder 97 against which the upper end of the ring seat member 92 abuts. A shoulder 98 at the upper end of the lower member 95 presses the ring seat member 92 against the shoulder 97 and locks it in place Referring to FIGS. 9(*a*) and 9(*b*), the ring seat member 92 comprises a rigid ring element 99 having a groove 99*a* in which is positioned a protruding urethane elastomer ring 100 having a hardness in the range Shore D-45 to 65. The rigid ring element 99 is formed on its inner edge with a tapered lip 105. The urethane ring 100 is provided with an upwardly curving surface 106, so that the seating area with the ball 93 will increase as the seating force increases. The diameters of the ball 93 and the urethane ring 100 are chosen to provide a seating angle of about 45 degrees so that a wedging action occurs when the ball 93 seats against the urethane surface 106. The ring element 99 is further provided with a bore 107, to permit fluid flow when the ball 93 is unseated. Upward movement of the ball 93 may be limited by transverse bar 101 positioned across the plunger member 94.

It will be noted that the lower end 95*a* of the plunger member 95 is spade-like in configuration and extends out of the bottom of the barrel 23 at the end of the downstroke—as shown in FIG. 5(*d*). This protruding, spade-like end 95*a* acts to disturb sand built up in the casing annulus 16 around the base of the barrel 23.

Turning now to the water tube 37 positioned in the plunger 36, it will be noted that it extends down through the plunger chamber 41 and connects with the transverse bar 101. A bore 102 connects the water tube bore 103 with an orifice outlet 40 communicating with the plunger chamber 41 above the travelling valve 43. This orifice 40 is sized in one model at about 0.120 inches diameter in order to maintain a suitable backpressure on the valve assembly 35 with the required flow rate.

OPERATION

The operation of the pump 3 will now be described, commencing with the change of the stroke from a downward to an upward direction. The positioning of the parts is illustrated in FIGS. 5(*a*) to 5(*d*). As the rod string 2 approaches the end of its downward travel, the valve assembly outer sleeve 55 contacts the lower coil spring 54*a* with the result that, as the downstroke continues, the spring 54*a* compresses. After compressing for some distance (usually chosen to be 2 to 4 inches), the spring force exerted by spring 54*a* on sleeve 55 will overcome the seating force of 50 to 100 pounds generated by the differential pressure acting on the slider member 57. The sleeve 55 and attached slider member 57 are then shifted upward The slider member upper ring 74 moves into sealing engagement with the ring seal 70 at the upper end of the housing member 56, while the slider member lower ring 75 disengages from the ring seal 71 at the lower end of the housing member 56. Water being pumped down the bore 14 of the rod string 2 passes through the slider bores 76, 77 and 78, the plunger rod bore 38, the bore 39, the water tube bore 103, and through the water tube outlet 40 into the plunger chamber 41. Thus, water is injected into the plunger chamber 41 and barrel chamber 47 on the upstroke. Also, the pressure generated in bore 39 acts to keep the ring 74 seated on ring seal 70 with a force of 50 to 100 pounds.

At the same time, as the rod string 2 and attached plunger rod 34 begin to move upward, the valve ball 93 is seated on the seat member 92 and the standing valve ring valve member 80, slidably mounted on rod 34 by means of seal rings 83, is lifted from its seat member 84 due to the pressure generated in the barrel chamber 47 as the fluid is compressed. This permits communication through the oil transfer port 32 between the barrel chamber 47 and the tubing annulus 12. The plunger 36, having a sealing contact with the barrel 23 by means of the seal rings 91, operates to swab or force the trapped fluid out of the barrel chamber 47 through the oil transfer port 32 into the tubing annulus 12, from whence it is eventually produced at surface. It should be noted that during the entire upstroke, fluid continues to flow through the water tube outlet 40 into the plunger chamber 41, since the seating force is generated throughout the stroke to maintain slider ring 74 seated on ring seal 70.

It will be noted that the injection of water into the plunger chamber 41 and barrel chamber 47, during the upstroke, ensures a measure of non-compressible fluid therein, with the result that displacement takes place and gas-locking is avoided.

As the rod string 2 approaches the end of its upward travel as dictated by the pump jack 1, the valve outer sleeve 55 contacts the upper coil spring 54, with the result that, as the upstroke continues, the spring 54 is compressed. After being compressed for some distance (usually chosen to be 2 to 4 inches), the spring force exerted by the spring 54 on the sleeve 55 will be sufficient to overcome the seating force of 50 to 100 pounds which was maintained by the differential pressure acting on the slider member 57. The sleeve 55 and attached slider member 57 are then shifted downward. As a result , the upper ring 74 of the slider 57 disengages from the upper ring seal 70 of the main body 56 and the lower ring 75 seals against the lower ring seal 71. Therefore, water being pumped down the tubing string bore 14 enters the housing member chamber 67 and exits through the water ports 65 into the water annulus 54 and from thence moves through the water ports 31 into the tubing annulus 12. Therefore water is injected into the column of fluid in the tubing annulus 12 on the downstroke to maintain upward flow and turbulence therein and thereby reduce sand settling, bridging and packing. Also, the water in chamber 67 is maintained at a higher pressure than that in the bore 69 and lower bore 38; therefore the slider member 57 is urged downward, so that lower ring 75 seats against lower seal ring 71 with a force of 50 to 100 pounds.

Also, at the inception of the downstroke, the standing valve 42 closes. As a result of the low pressure condition within the barrel chamber 47, caused by the downward travel of the plunger 36, the travelling valve 43 opens. A charge of reservoir fluid is then able to enter the plunger chamber 41 and barrel chamber 47. The cycle as previously described then is repeated.

The lower extremity of plunger 36 and travelling valve 43 comprises spade-like member 95, which is adapted to stroke out of the end of barrel 23 at the bottom of the stroke. Projector 95*a* of shovel member 95 is pointed and tapered, so that it can break up sand agglomerations as the member 95 strokes downwardly. Also, the funnel-shaped lower extremity 44 of member 95 functions to ingest sand and fluid on the downstroke so that the material may move up through the travelling valve 94 into the plunger chamber 41.

One of the preferred features of the pump is that it is particularly well suited to pump a fluid mixture containing sand.

Heretofore, the downhole oil well pump industry has in the main dealt with the erosion problems created by sand simply by hardening the seal surfaces.

Applicant has taken a different course. More particularly, applicant has provided soft, deformable, resilient, protruding, annular elastomer elements at each and every one of the three seal areas (that is, at the travelling valve, the standing valve, and between the plunger and barrel).

This was done with the following thoughts in mind. If two hardened steel surfaces are relied on to effect the seal at each seal area, there is a possibility that a sand grain will get between them and hold them slightly apart, so that water and more sand can squeeze therethrough at high pressure and rapidly erode them. Alternatively, fine sand will get into the finest clearance and wear the surfaces.

In response to this, applicant has provided soft deformable resilient annular elastomer seal elements which deform and absorb the sand grains in issue until they can later be released when the elastomer element moves out of the close fit seal area.

Pumps provided with the elastomer elements as described in the three seal areas have been tested in wells of the Lloydminster, Alberta area and have been found to have much longer operational lives than the prior art pumps, having both seal surfaces formed of hardened steel, which were previously used in those wells.

There is another problem commonly encountered in wells, such as those of Lloydminster, which produce a fluid carrying much entrained sand. The sand tends to settle out of the fluid in the casing annulus and packs around the base of the pump. This sand then functions to starve the pump for fluid.

Applicant has alleviated this problem by arranging for the plunger to stroke out the bottom of the barrel, thereby disturbing the sand pack and rendering it better pumpable.

In summary then, Applicant has provided an improved sandmoving oil well downhole pump by equipping the three seal areas with the soft deformable resilient protruding annular elastomer elements. And in a preferred embodiment, Applicant has combined the feature of stroking the spade-like member 95 out the bottom of the barrel with the previously described seal system to provide a pump better able to cope with the problems of sand build-up and sand movement.

SECOND EMBODIMENT

Figure 6A:
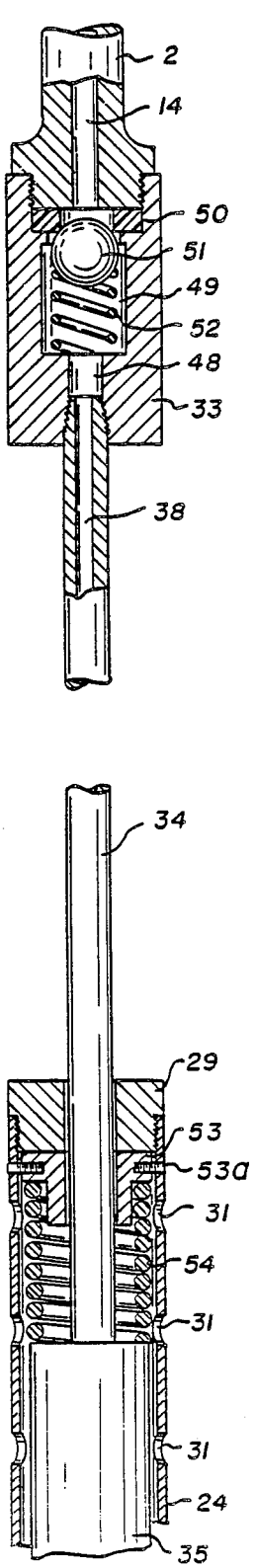
FIGS. 6(*a*), 6(*b*), 6(*c*) and 6(*d* ) are similar to the corresponding FIG. 5 , except that they show the pump parts at the top of the stroke.
Figure 6C:
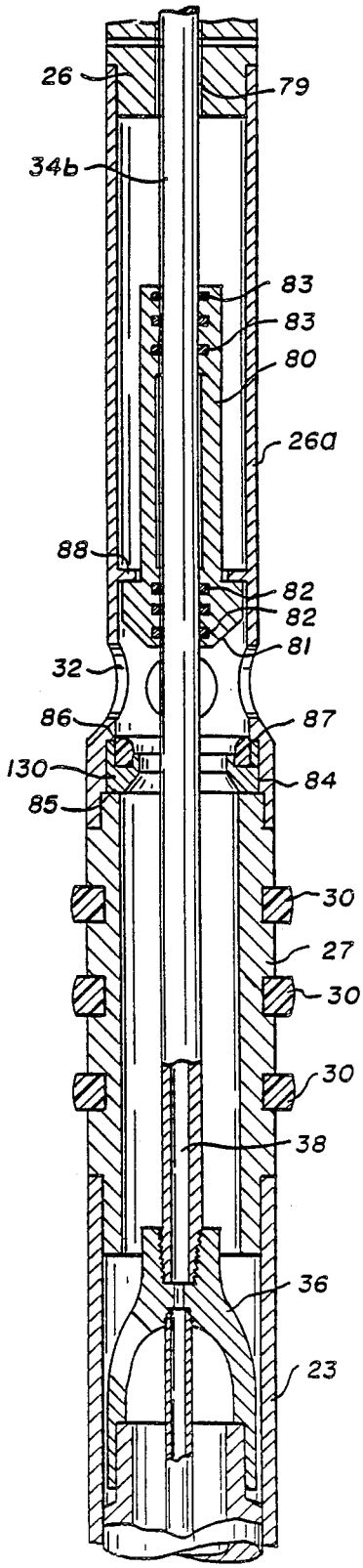

The first-developed assembly shown in FIGS. 5–7 was found to be limited in use because the orifice 40 was small and would tend to plug with solids. The orifice had to be small, in order to maintain the back pressure needed for operation of the slider valve assembly. Thus the first embodiment required that only clean water be injected, which is not easy to ensure in the oilfields.

Thus a second embodiment, shown in FIGS. 14 to 20, was developed. This second embodiment involves the concept of injecting water into the barrel chamber through a relatively unrestricted conduit for a time period extending only over the bottoming phase of the stroke.

Figure 14A:
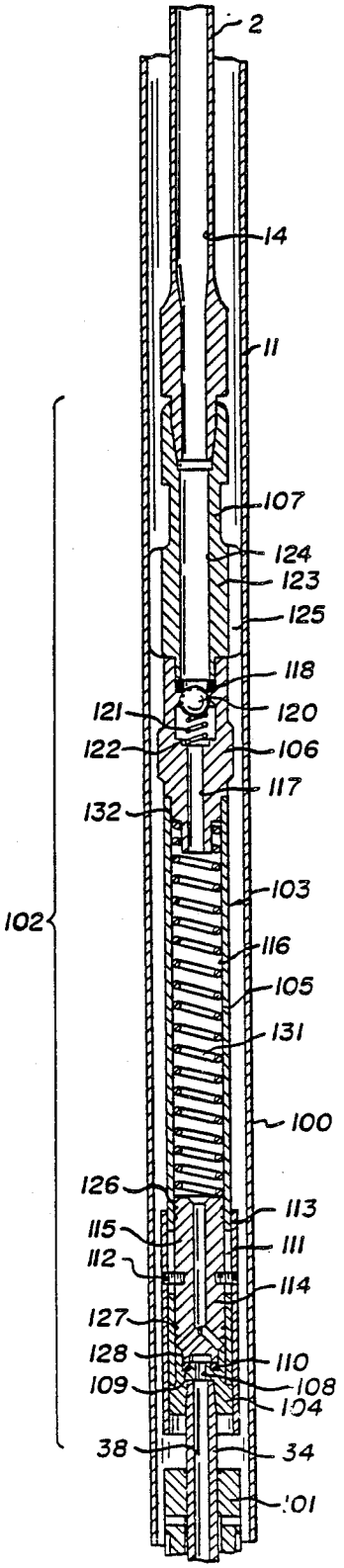
FIGS. 14*a* and 15*a* and 16*a* are sectional side views showing an alternative embodiment of the pump on the downstroke.
Figure 15A:
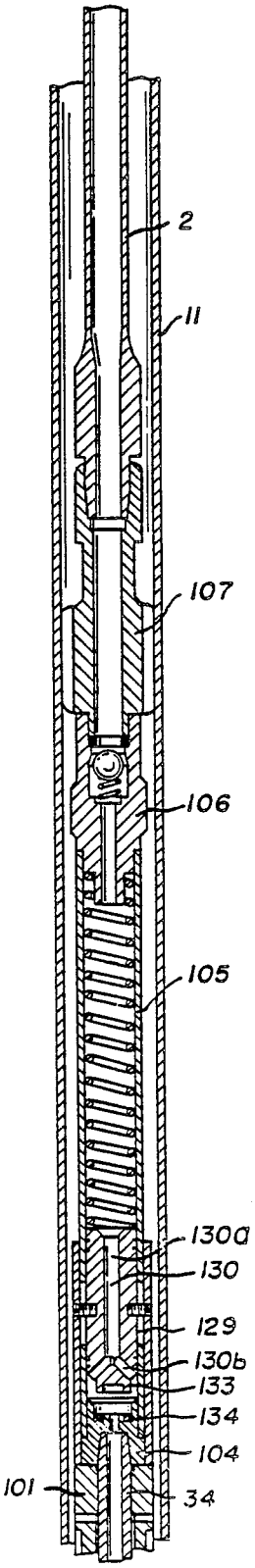
Figure 16A:
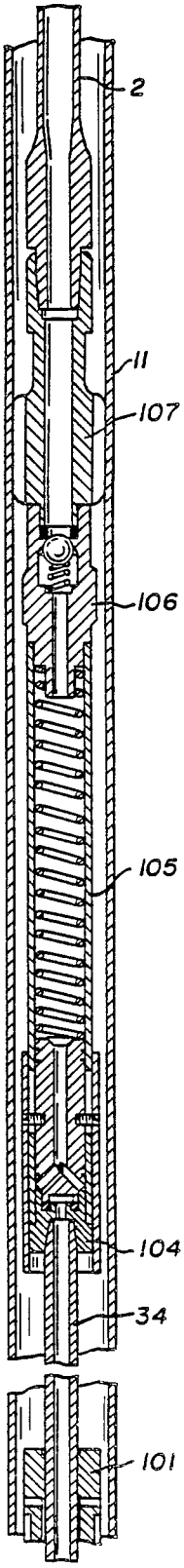
Figure 14B:
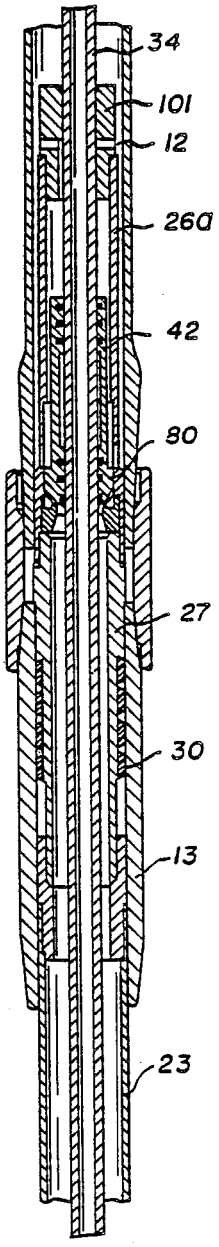
FIGS. 14*b*, 15*b* and 16*b* show the alternative embodiment in side section at the base of the downstroke.
Figure 15B:
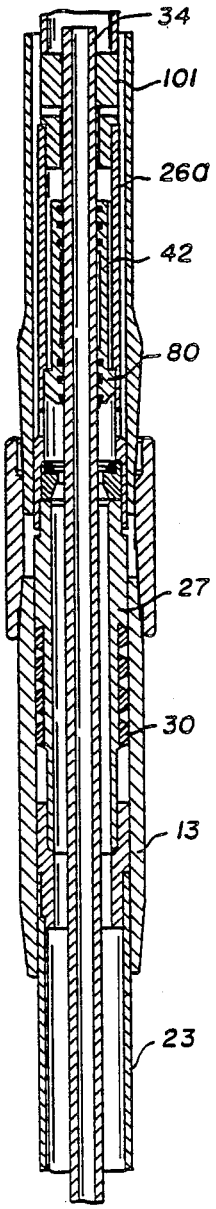
Figure 16B:
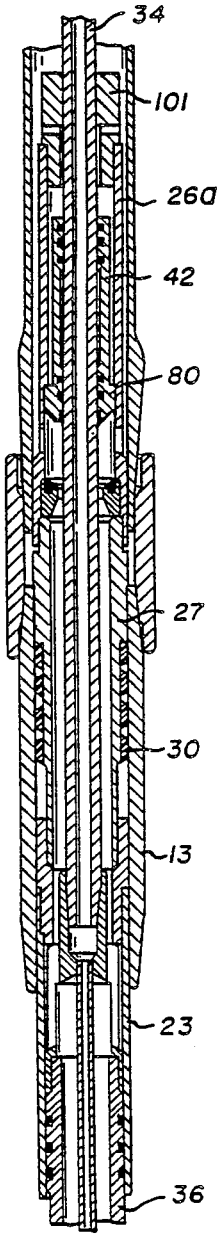
Figure 14C:
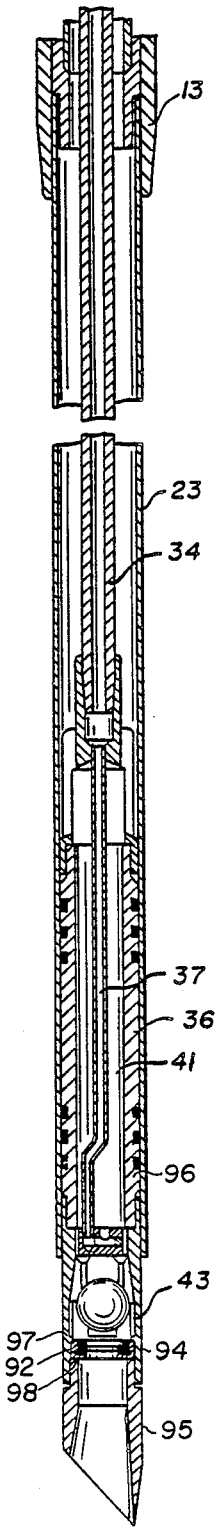
FIGS. 14*c*, 15*c* and 16*c* show the alternative embodiment in side section on the upstroke.
Figure 15C:
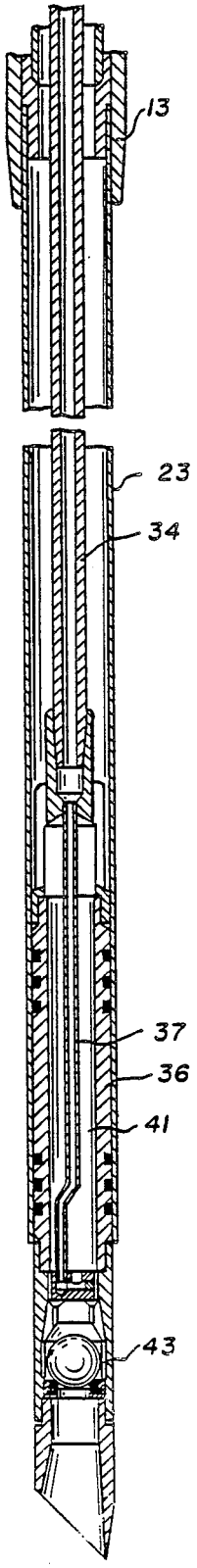
Figure 16C:
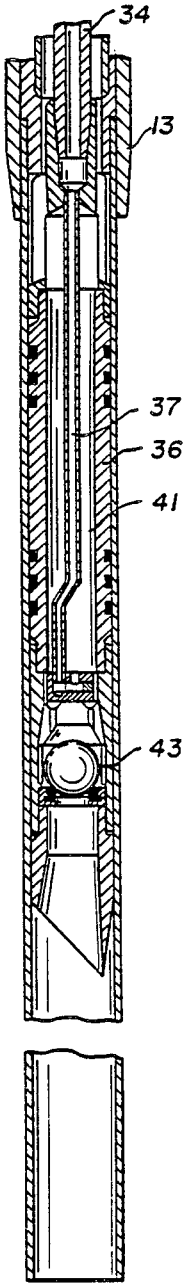

The second embodiment that is shown in FIGS. 14–16 is identical in certain respects to the first embodiment shown in FIGS. 2–13. The components that are common to the two will therefore not be described below in detail. The same numerals will be used to identify such common components.

The barrel is modified in this alternative embodiment, in that the upper segment 24 has been eliminated. Thus the barrel comprises only the tubular section 23 and a vertically bored closure member 101 connected to the section 23 at its upper end.

Also, the first embodiment water tube 37 is modified in this alternative embodiment by incorporating an orifice outlet 40 that is relatively larger and non-restrictive.

Aside from these two changes, the barrel, plunger and standing and travelling valve assemblies of the two embodiments are the same.

The remaining changes have to do with the valve assembly 102, which is provided in the second embodiment in place of the valve assembly 35, to control fluid injection into the pump barrel.

The valve assembly 102 includes a generally tubular housing member 103 shown to be made up of an-assembly of threaded-together parts. More particularly, the housing member 103 comprises, from bottom to top: a seat member 104, a vertically slotted tube 105; and an upper closure member 106.

The housing member 103 is threadably connected at top and bottom with the rod string 2 and plunger rod 34 respectively. These three interconnected elements together form a reciprocating unit.

Turning to the seat member 104, it has a central vertical bore 108 and is threaded onto the plunger rod 34. The bore 108 communicates with the plunger rod bore 38. An annular groove 109 is cut in the upper horizontal end face of the seat member 104. This groove 109 circumscribes the bore 108. A horizontal ring seal 110 is positioned in the groove 109 At its upper end, the seat member 104 is externally threaded for connection with the slotted tube 105.

The slotted tube 105 is internally threaded at its lower and upper ends. These ends are respectively threaded onto the seat member 104 and the upper closure member 106. Adjacent its lower end, the wall of the slotted tube 105 forms longitudinally extending slots 111. These slots 111 accommodate the outwardly projecting pins 12 which interconnect the sleeve 113 and slider member 114, described below. The slotted tube 105 defines a central vertical bore 116 extending therethrough.

The upper closure member 106 is externally threaded at its lower end, for connection with the slotted tube 105. Said upper closure member 106 forms a central vertical bore 117 which communicates at its lower end with the slotted tube bore 116. At its upper end, the upper closure member 106 is internally threaded for connection with the threaded lower end of a centralizer member 107 forming part of the rod string. A horizontal ring seal 118 is positioned between the internal shoulder 119 of the upper closure member 106 and the lower end face of the centralizer member 107. A ball 120 is positioned within the bore 117 and is normally urged upwardly against the ring seal 118 by a spring 121, which acts against a second internal shoulder 122 of the upper closure member 106. The check valve so formed acts to prevent upward passage of fluid from the pump 100 into the rod string 2, while permitting downward passage of fluid.

The centralizer member 107 is threaded at its lower and upper ends for connection respectively with the check valve body 106 and the remainder of the rod string 2. A bore 124 extends longitudinally through the centralizer member 107 and communicates with the upper closure member bore 117 and the rod string bore 14. The wide section 125 of the member 107 functions to centre the assembly in the tubing string 11, in conventional fashion.

A slider assembly 115 is associated with the housing member 103. This assembly 115 comprises: a cylindrical slider member 114, positioned within the slotted tube 105; a tubular sleeve 113 positioned around the slotted tube 105; and transverse pins 112 extending through the slots 111 and interconnecting the slider member 114 and sleeve 113.

Figure 17A:
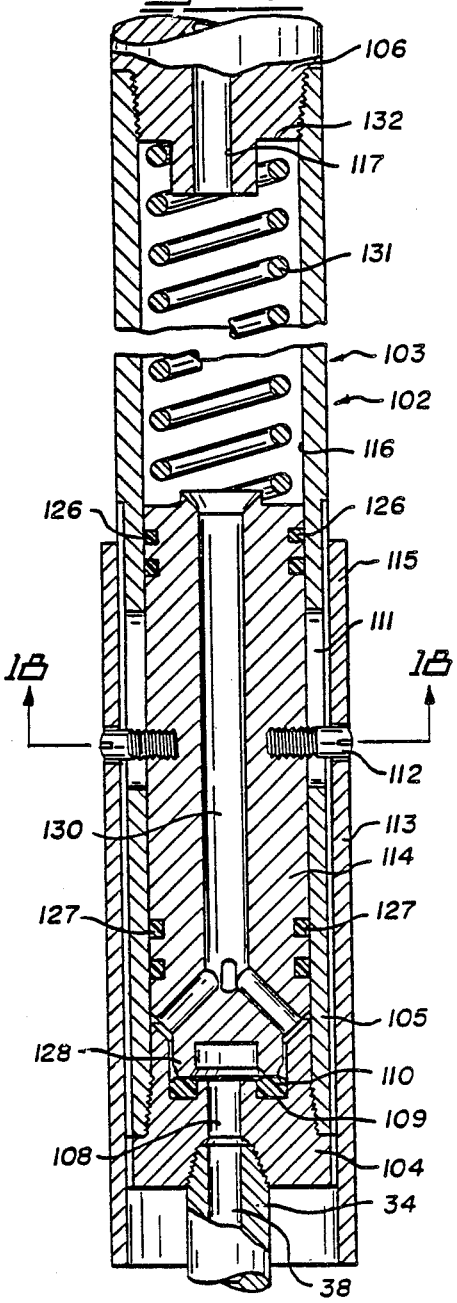
FIGS. 17*a* and 17*b* are sectional side views which show the shift valve assembly of said alternative embodiment in the second (closed) and first (open) positions.
Figure 17B:
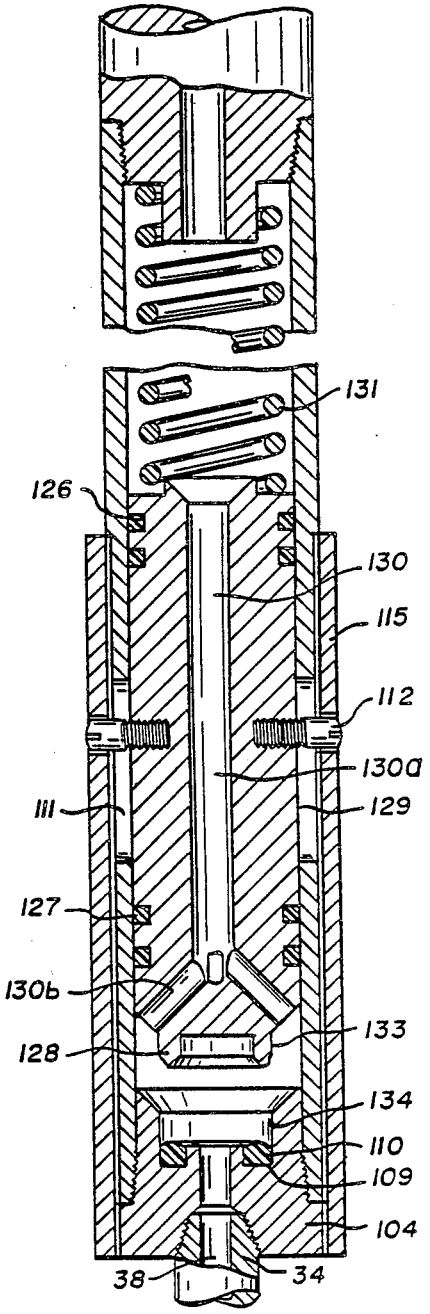
Figure 18:
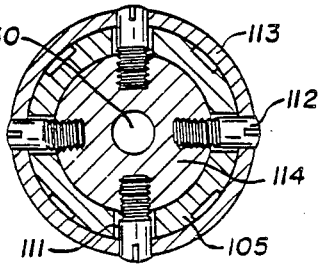
FIG. 18 is a sectional top view taken along the line 18—18 of FIG. 17*a;*

The slider assembly 115 may move between closed and open positions shown respectively in FIGS. 17*a* and 17*b*.

O-ring seals 126, 127 are mounted in the outer surface of the slider member 114 at positions above and below the slots 111. These seals 126, 127 seal against the interior surface of the slotted tube 105. Thus fluid is prevented from passing between the slider member 114 and the slotted tube 105.

The slider member 114 has a valve ring 128 extending downwardly from its lower horizontal end face. This valve ring 128 is adapted to seat against the ring seal 110 carried by the seat member 104, when the slider assembly 115 is in the closed position. The ring valve 128 is inwardly spaced from the side surface 129 of the slider 114, to delineate an annular land.

A bore or first passage 130 extends longitudinally through the slider member 114. The bore 130 consists of a central upper section 130*a* and outwardly diverging lower sections 130*b*. The bore sections 130*b* terminate at the annular land of the slider 114, to the outside of the valve ring 128.

It follows that, if the valve ring 128 is seated against the ring seal 110, which occurs when the slider assembly 115 is in the closed position, the slider bore 130 is blocked off from communicating with the seat member bore 108 (and thus from the plunger rod bore 38). If the valve ring 128 is unseated, having been shifted to the open position, the slider bore 130 communicates with the seat member bore 108 (and thus with the plunger rod bore 38).

From the foregoing, it will be noted that a fluid injection passage extends downwardly from ground surface into the barrel chamber 47. However this passage includes a movable portion, the slider bore 130, which is slidable between the open and closed positions so that it is operative to complete the passage or it is blocked off so as to interrupt fluid movement through the passage.

In the closed position, the slider sleeve 113 extends below the bottom end of the tubular body 103. In this situation, the sleeve 13 may contact the upper end 101 of the stationary barrel 23 as the tubular unit approaches the end of its downward stroke. On contacting upper end 101, the downward travel of the slider assembly 115 is arrested and the housing member 103 slides downwardly relative to it. As a result, the slider valve ring 128 is unseated from the tubular body ring seal 10 and the slider bore 130 is opened or unblocked and completes the fluid injection passage between the rod string bore 14 and the plunger rod bore 38.

A coil spring 131 is positioned within the slotted tube 105. This spring 131 is always in compression. It extends between the slider member 114 and the upper closure member's shoulder 132 and acts to urge the slider member 114 downwardly. When the slider assembly 115 is in the process of assuming the open position, the downward movement of the housing member 103 through the stationary slider 113 and sleeve 114, causes maximum compression of the spring 131. When the reciprocating unit begins to move upwardly on the upstroke and the slider assembly 115 is lifted out of contact with the upper end 101 of the barrel 23, the spring 131 acts to bias said slider assembly into the closed position.

A choking action is inherently incorporated into the valve assembly 102, as described. More particularly, a narrow clearance exists between the outer surface 133 of the valve ring 128 and the inner surface 134 of the seat member 104. These two surfaces 133, 134 are formed of metallurgically hardened material. They cooperate to provide a throttling action on the injected fluid flow as the valve assembly opens.

Figure 19A:
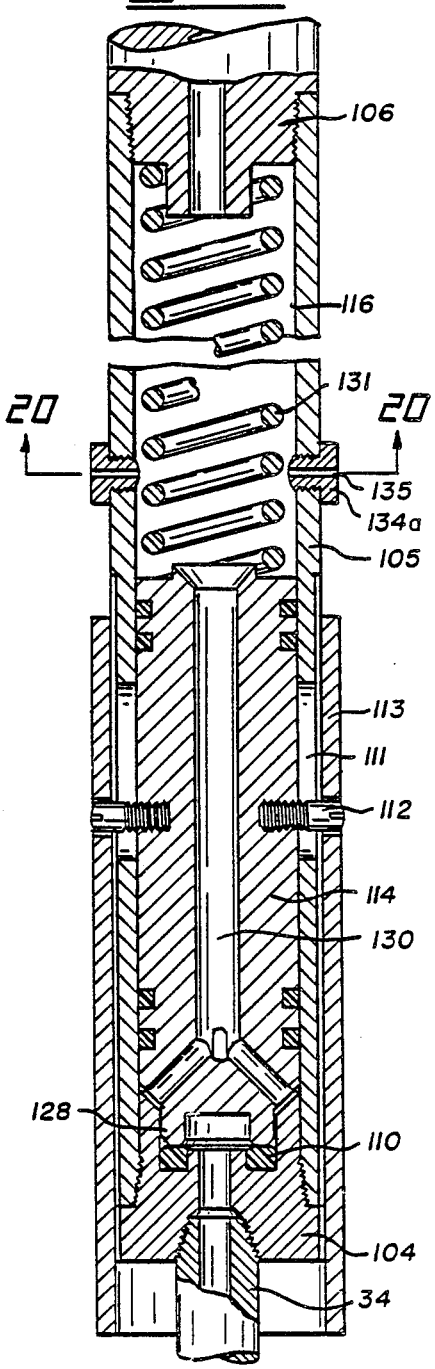
FIGS. 19*a* and 19*b* are sectional side views showing a shift valve assembly in accordance with FIGS. 17*a* and 17*b*, but having means for enabling fluid to be injected into the tubing annulus.
Figure 19B:
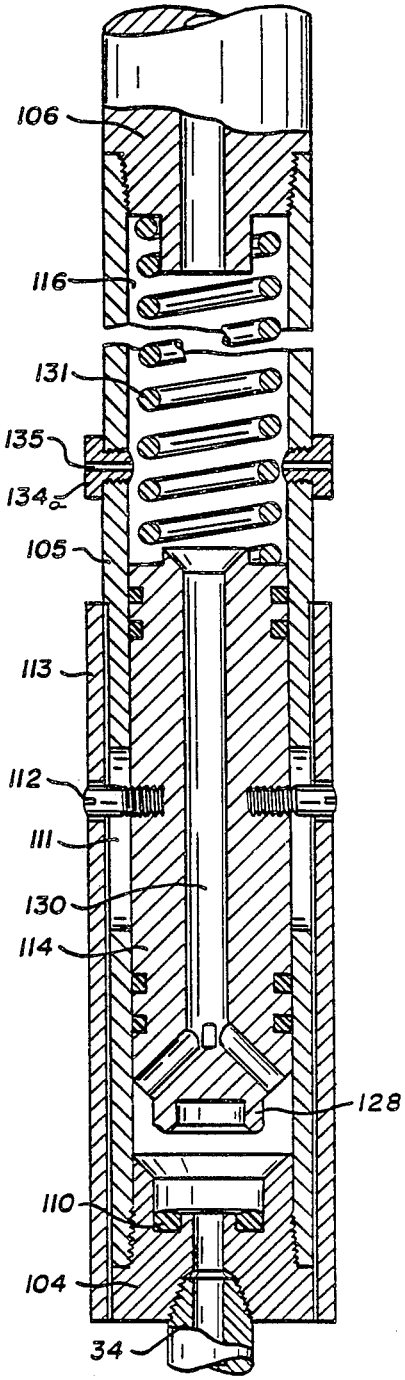
Figure 20:
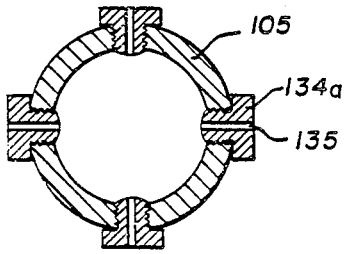
FIG. 20 is a sectional top view taken along the line 20—20 of FIG. 19*a;*

If desired, one may easily modify the valve assembly 102 as shown in FIGS. 19—20 to permit fluid to be continuously injected into the tubing annulus 12. This may be accomplished by providing outlet port members 134*a* in the wall of the slotted tube 105. These outlet port members 134*a* form bores 135 through which fluid may continuously be injected into the tubing annulus 12.

Figure 21A:
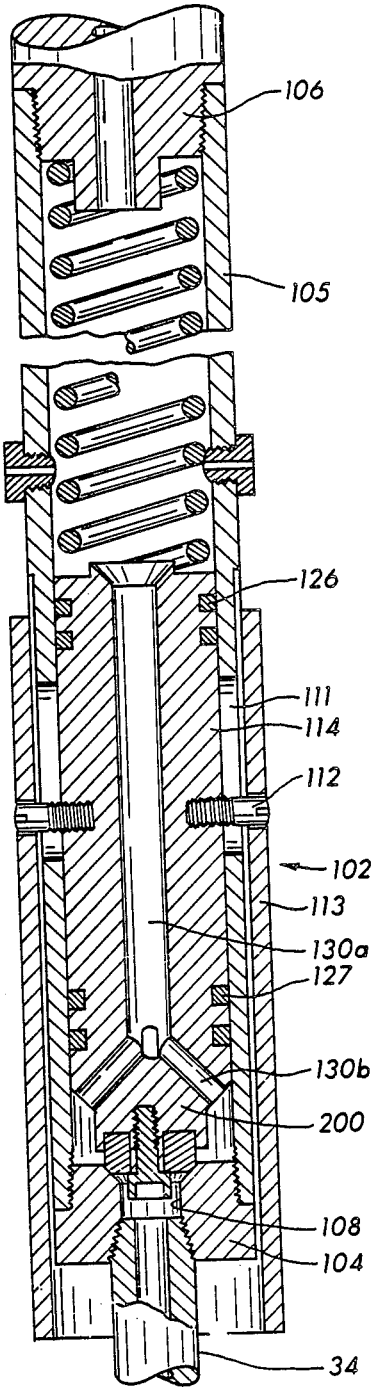
FIGS. 21(*a*) and 21(*b*) are sectional side views which show a second embodiment of the shift valve assembly in the closed and open positions respectively.
Figure 21B:
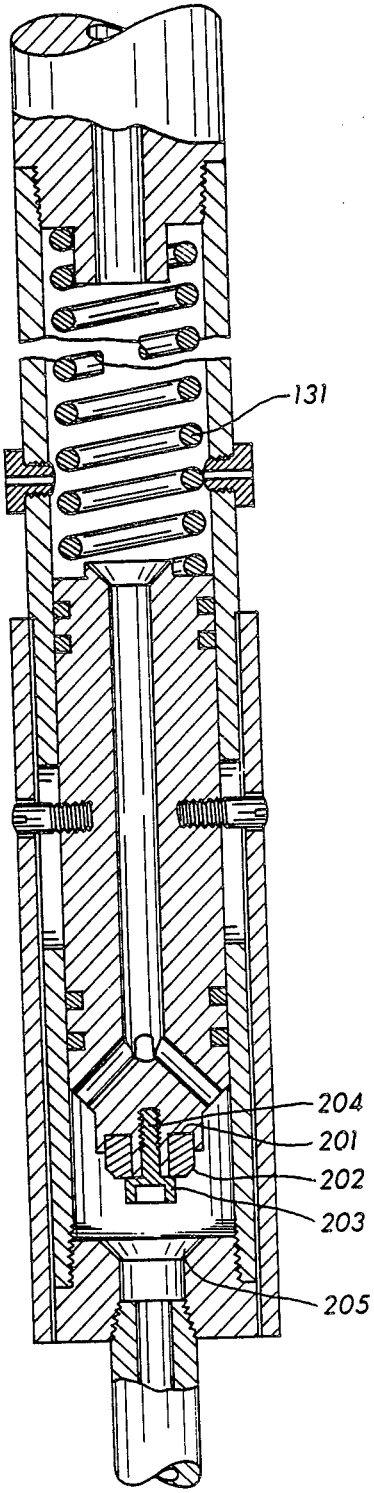
Figure 22:
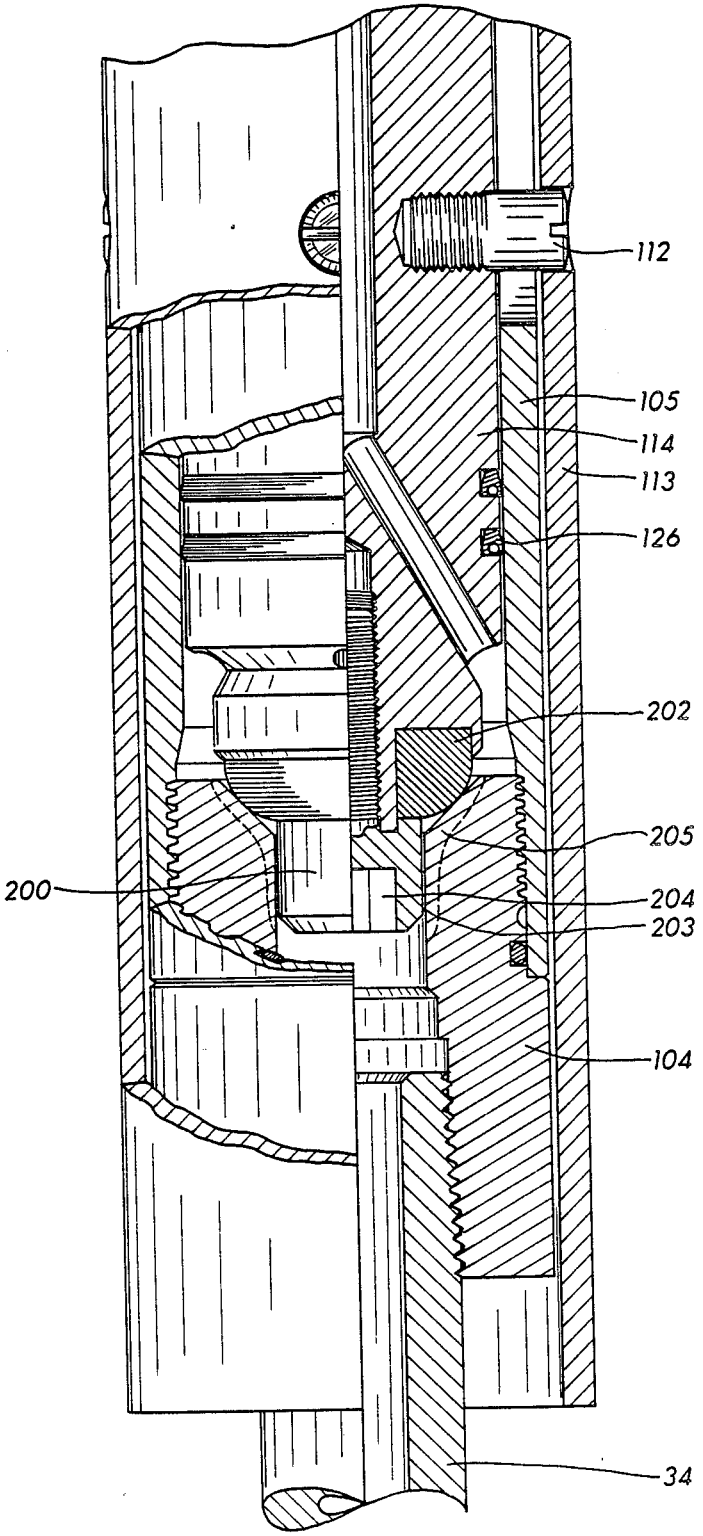
FIG. 22 is an enlarged partly broken away side view of the bottom shut-off assembly of the shift valve assembly.

A most preferred form of the valve assembly 102 is shown in FIGS. 21—22. This form of the valve assembly 102 is the same as that of FIGS. 17*a* and 17*b*, except with respect to the bottom shut-off seal assembly which is created when the slider member sits down on the housing member. The most preferred form has been devised because, while the bottom shut-off seal assembly of FIG. 17 works, there is a tendency for the urethane ring seal 110 to be washed out in the last stages of opening and closing, when the injected water is passing at high velocity through the remaining narrow clearance between the closing surfaces of the valve ring 128 and ring seal 110.

In the most preferred form, the bottom end of the slider member 114 is formed to provide a downwardly projecting cylindrical nose 200. A circular groove 201 is formed in the nose 200. A urethane ring seal 202 is seated in the groove 201. A ring 203 and bolt 204, threaded into the nose 200, hold the ring seal 202 in place. The ring 203 is heat treated to ensure that it has good wear resistance.

The bore 108 of the seat member 104 is internally hardened and has a diameter such that it snugly receives the slider nose 200. At its upper end the seat member 104 is formed to provide a hardened tapered seat 205.

In operation, as the slider member 114 unseats, the ring seal 202 is displaced off seat 205, allowing fluid flow between them. But this flow is severely choked between the surface of seat member bore 108 and the slider nose ring 203, both of which are hardened. Thus the sealing element, the urethane ring seal 202, is not damaged during the time that it is closely spaced from the seat 205. Similarly, when the slider member is closing, the flow through the bore 108 is choked by the entry of the slider nose ring 203 over the interval when the urethane ring seal 202 is closely approaching the tapered seat 205.

It is to be understood that the invention is not to be limited to incorporation with the oil well downhole reciprocating pump shown in the drawing, wherein the travelling valve is positioned in the plunger and the standing valve is at the upper end of the barrel chamber. There are commercially available pumps, which could usefully use Applicant's novel seal combination and/or the slider valve, which pumps have the standing valve located at the base of the barrel. The incorporation of the invention with such latter pumps is contemplated to be within the scope of the invention.

The embodiments of the invention in which an exclusive property or privilege is claimed are defined as follows:

1. A method for reducing gas locking of an oil well downhole reciprocating pump seated in a well, said well being equipped with an outer tubing string and an inner tubular rod string connected with the pump for reciprocating the pump, said pump having a tubular barrel, seated in the tubing string and forming an internal barrel chamber, a plunger assembly comprising a hollow plunger disposed in the barrel chamber and a tubular plunger rod extending into the barrel chamber and being connected with the plunger, said plunger assembly communicating with the barrel chamber and being connected with the rod string to form therewith a reciprocating unit, said rod string being connected at surface with means for injecting liquid thereinto, and a valve assembly connected into and forming part of the reciprocating unit above the plunger rod, said valve assembly being adapted to control liquid flow through the unit into the barrel chamber, and a stop member carried by the tubing string or the pump barrel and positioned to contact the valve assembly when the rod string is at about the bottom of its downstroke, said method comprising:

injecting liquid into the rod string;

opening the valve assembly, when the rod string is at about the bottom of its downstroke, by bringing said valve assembly, as a result of its movement with the rod string, into contact with the stationary stop member, to thereby initiate liquid flow into the barrel chamber from the rod string; and closing the valve assembly, as the rod string rises on the upstroke, in response to removing said valve assembly out of contact with the stop member, to thereby terminate liquid flow into the barrel chamber from the rod string;

whereby some substantially incompressible liquid is introduced into the barrel chamber so as to be present there during the upstroke, to thereby reduce gas locking of the pump.

2. An assembly for pumping an oil-producing well having a well bore, comprising:

a tubing string installed in the well;

a downhole pump seated in the tubing string;

a reciprocable tubular rod string, positioned in the tubing string, for actuating the pump, said rod and tubing strings forming a tubing annulus between them;

means, connected with the rod string at ground surface, for reciprocating said rod string;

means, connected with the rod string at ground surface, for injecting liquid into the bore of the rod string;

said pump comprising a tubular open-bottomed barrel forming an internal chamber, a hollow plunger positioned in the barrel chamber in slidable sealing engagement with said barrel's inner surface, said plunger closing off the lower end of the chamber, a travelling valve assembly, carried by the plunger, for controlling and enabling fluid to flow from the well bore through the plunger into the barrel chamber on the down stroke of the rod string, said travelling valve assembly being adapted to close at the start of the upstroke and to open again at the start of the downstroke, and a tubular plunger rod connected with the plunger to form a plunger assembly, said plunger assembly communicating with the barrel chamber and being connected with the rod string to form a reciprocating unit;

a standing valve assembly, having parts mounted on each of the reciprocating unit and the upper end of the barrel, said assembly being operative to permit fluid to flow from the barrel chamber into the tubing annulus on the upstroke of the rod string;

a valve assembly, being interconnected with and forming part of the reciprocating unit above the plunger rod, said valve assembly being convertible between an open position, in which liquid injected into the rod string bore may pass through the valve assembly into the plunger rod bore and the barrel chamber, and a closed portion, in which liquid in the rod string bore is blocked from moving into the barrel chamber;

a stationary stop member carried by one of the barrel or the tubing string;

said valve assembly including a movable first member arranged to contact the stop member, when the rod string is approaching the bottom of its downstroke, to open the valve assembly in reaction to said contact and the concomitant stopping of the first member's movement, said valve assembly being operative to automatically close when the first member is removed from contact with the stationary stop member by the upward movement of the reciprocating unit on the upstroke;

whereby some liquid may be introduced, through the rod string, valve assembly and plunger rod, into the barrel chamber in conjunction with the bottoming of the stroke, to reduce gas locking of the pump.

3. An assembly for pumping an oil-producing well having a well bore comprising:

a tubing string installed in the well;

a downhole pump seated in the tubing string;

a reciprocable tubular rod string, positioned in the tubing string, for actuating the pump, said rod and tubing strings forming a tubing annulus between them;

means, connected with the rod string at ground surface, for reciprocating said rod string;

means, connected with the rod string at ground surface, for injecting liquid into the bore of the rod string;

said pump comprising a tubular open-bottomed barrel forming an internal chamber, a hollow plunger positioned in the barrel chamber in slidable sealing engagement with said barrel's inner surface, said plunger closing off the lower end of the chamber, a travelling valve assembly, carried by the plunger, for controlling and enabling fluid to flow from the well bore through the plunger into the barrel chamber on the downstroke of the rod string, said travelling valve assembly being adapted to close at the start of the upstroke and to open again at the start of the downstroke, and a tubular plunger rod connected with the plunger to form a plunger assembly, said plunger assembly communicating with the barrel chamber and being connected with the rod string to form a reciprocating unit;

a standing valve assembly, having parts mounted on each of the reciprocating unit and the upper end of the barrel, for closing off the upper end of the barrel chamber, said standing valve assembly being operative to permit fluid to flow from the barrel chamber into the tubing annulus on the upstroke of the rod string, a valve assembly, being interconnected with and forming part of the reciprocating unit above the plunger rod, said valve assembly being convertible between an open position, in which liquid injected into the rod string bore may pass through the valve assembly into the plunger rod bore and the barrel chamber, and a closed position, in which liquid in the rod string is blocked from moving into the barrel chamber;

a stationary stop member carried by one of the barrel or the tubing string;

said valve assembly including a movable first member arranged to contact the stop member, when the rod string is approaching the bottom of its downstroke, to open the valve assembly in reaction to said contact and the concomitant stopping of the first member's movement, said valve assembly being operative to automatically close when the first member is removed from contact with the stationary stop member by the upward movement of the reciprocating unit on the upstroke;

whereby some liquid may be introduced, through the rod string, valve assembly and plunger rod, into the barrel chamber in conjunction with the bottoming of the stroke, to reduce gas locking of the pump.

4. A valve assembly, for connection in a reciprocating unit comprising a tubular rod string and the tubular plunger rod of a downhole pump, for controlling the injection of water through the rod string and plunger rod, comprising:

a tubular housing member having a side wall having upper and lower ends and forming an internal bore and at least one vertical slot formed through its side wall and extending part way along its length;

a first member associated with the housing member at its lower end, said first member having a transverse wall and forming a centrally located substantially vertical first bore extending downwardly through the wall, said first member being connectable at its bottom end with the lower end portion of the reciprocating unit so that the first bore will communicate with the bore of the plunger rod, said first member forming a first annular seal surface on the transverse wall around the first bore, said annular seal surface being inwardly spaced from the side wall of the housing member;

a second member associated with the housing member at its upper end, said second member forming a substantially vertical second bore, said second member being connectable at its upper end with the upper end portion of the reciprocating unit so that the second bore will communicate with the bore of the rod string;

a cylindrical slider member is disposed in the housing member bore, said slider member having a longitudinal bore extending therethrough which communicates with the housing member bore at the lower end of the slider member between the first annular seal surface and the housing member side wall, said slider member carrying a second annular seal surface adapted to seal against the first annular seal surface when the slider member abuts the first member;

a third member extending vertically along the outside surface of the housing member;

means, extending through the slot, for interconnecting the slider member and the third member, whereby the slider member and third member are adapted to move vertically as a unit a short distance along the extent of the slot;

means, positioned between the housing member and the slider member above and below the slot, for sealing to prevent liquid movement between said members;

and spring means positioned in the housing between the second member and the slider member, for normally urging the slider member downwardly to abut the first member whereby the slider member seal surface will contact the first annular seal surface and interrupt communication between the slider member bore and the first bore.

5. The valve assembly as set forth in claim 4 wherein:

the first annular seal surface is a seat;

the slider member comprises a downwardly projecting cylindrical nose member at its lower end, adapted to enter the first bore to choke flow therethrough prior to engagement of the annular seal surfaces;

and the slider member further comprises a ring of resilient material mounted in the nose member to provide the second annular seal surface.

6. The valve assembly as set forth in claim 5 wherein:

the third member is a tubular sleeve extending about the housing member and connected by pins with the slider member.

* * * * *